US011388954B2

(12) United States Patent
Bradley

(10) Patent No.: US 11,388,954 B2
(45) **Date of Patent: *Jul. 19, 2022**

(54) HEEL PAD HAVING A MALLEABLE MEMBER AND METHOD OF USE

(71) Applicant: INTRICATE FORTE, INC., Latham, NY (US)

(72) Inventor: Tina B. Bradley, Latham, NY (US)

(73) Assignee: INTRICATE FORTE, INC., Latham, NY (US)

( * ) Notice: Subject to any disclaimer, the term of this patent is extended or adjusted under 35 U.S.C. 154(b) by 75 days.

This patent is subject to a terminal disclaimer.

(21) Appl. No.: 16/710,438

(22) Filed: Dec. 11, 2019

(65) Prior Publication Data

US 2020/0113288 A1 Apr. 16, 2020

Related U.S. Application Data

(63) Continuation of application No. 15/934,459, filed on Mar. 23, 2018, now Pat. No. 10,548,371, which is a (Continued)

(51) Int. Cl.
*A43B 23/28* (2006.01)
*A43B 21/00* (2006.01)

(Continued)

(52) U.S. Cl.
CPC ..... *A43B 23/28* (2013.01); *A43B 1/08* (2013.01); *A43B 21/00* (2013.01); *A43B 1/0054* (2013.01);

(Continued)

(58) Field of Classification Search
CPC ..... A43B 23/28; A43B 23/30; A43B 7/1465; A43B 7/18; A43B 7/20; A43B 7/22;

(Continued)

(56) References Cited

U.S. PATENT DOCUMENTS

| | | | |
|---|---|---|---|
| 325,280 | A | 9/1885 | Nathan |
| 763,934 | A | 6/1904 | Stawartz |

(Continued)

FOREIGN PATENT DOCUMENTS

| | | | |
|---|---|---|---|
| CA | 2982929 | * | 10/2016 |
| CA | 199489 | | 11/2020 |
| WO | 2016/168072 | | 10/2016 |

OTHER PUBLICATIONS

International Search Report and Written Opinion of the International Searching Authority, dated Jun. 30, 2016, from International Application No. PCT/US2016/026606, Apr. 8, 2016. Seven pages.

(Continued)

*Primary Examiner* — Ted Kavanaugh
(74) *Attorney, Agent, or Firm* — Gottlieb, Rackman & Reisman, PC

(57) ABSTRACT

A heel pad for placement within a shoe and a method of use. The heel pad includes a pliable body, a filler element contained within the pliable body, and a malleable member fastened within the pliable body and extending along at least part of a length of the pliable body. In use, the heel pad is positioned in a heel section of the shoe. A longitudinal end of the heel pad is folded along an upper edge of the heel section of the shoe. The folded longitudinal end of the heel pad is affixed to an outer surface of the heel section of the shoe.

11 Claims, 32 Drawing Sheets

Related U.S. Application Data continuation-in-part of application No. 15/566,162, filed as application No. PCT/US2016/026606 on Apr. 8, 2016, now abandoned.

(60) Provisional application No. 62/148,942, filed on Apr. 17, 2015.

(51) Int. Cl.

| | |
|---|---|
| ***A43B 1/08*** | (2006.01) |
| *A43B 1/00* | (2006.01) |
| *A43B 23/08* | (2006.01) |
| *A43B 7/144* | (2022.01) |
| *A43B 7/1405* | (2022.01) |
| *A43B 7/1464* | (2022.01) |

(52) U.S. Cl.

CPC ..... *A43B 1/0081* (2013.01); *A43B 7/141* (2013.01); *A43B 7/144* (2013.01); *A43B 7/1464* (2022.01); *A43B 23/088* (2013.01)

(58) Field of Classification Search

CPC .. A43B 7/24; A43B 7/28; A43B 13/34; A43B 21/32

See application file for complete search history.

(56) References Cited

U.S. PATENT DOCUMENTS

| | | | | |
|---|---|---|---|---|
| 1,155,209 | A | 9/1915 | Burke | |
| 1,192,433 | A | 7/1916 | Krieger | |
| 1,548,172 | A | 8/1925 | Redden | |
| 1,586,698 | A | 6/1926 | Posner | |
| 1,596,288 | A | 8/1926 | Miller | |
| 1,718,619 | A | 6/1929 | Watanabe | |
| 1,838,487 | A | 12/1931 | Josephs | |
| 1,844,280 | A | 2/1932 | Hacker et al. | |
| 1,946,591 | A | 2/1934 | Saito | |
| 2,634,515 | A | 4/1953 | Saitta | |
| 2,700,229 | A | 1/1955 | Dubin | |
| 2,716,249 | A | 8/1955 | Holloway | |
| 3,063,172 | A | 11/1962 | Beattie | |
| 3,112,571 | A | 12/1963 | Musgrave | |
| 3,359,660 | A * | 12/1967 | Nadaud | A43B 21/32 36/37 |
| 3,400,474 | A | 9/1968 | Tendler | |
| 4,503,628 | A | 3/1985 | Mancinelli et al. | |
| 4,642,916 | A | 2/1987 | Collins | |
| 4,724,847 | A | 2/1988 | Nelson | |
| 5,007,417 | A | 4/1991 | Bender | |
| 5,090,140 | A | 2/1992 | Sessa | |
| D328,965 | S | 9/1992 | Ewing | |
| 5,152,082 | A | 10/1992 | Culpepper | |
| 5,459,947 | A | 10/1995 | Lasher | |
| D374,336 | S | 10/1996 | de Silva et al. | |
| 5,584,707 | A | 12/1996 | Volz et al. | |
| 5,842,292 | A | 12/1998 | Siesel | |
| D411,758 | S | 7/1999 | Karim | |
| 6,170,175 | B1 | 1/2001 | Funk | |
| 6,584,707 | B1 | 7/2003 | Racine et al. | |
| 7,049,478 | B1 | 5/2006 | Smith | |
| 7,168,188 | B2 | 1/2007 | Auger et al. | |
| 7,204,043 | B2 | 4/2007 | Kilgore | |
| D571,540 | S | 6/2008 | Granito | |
| D667,630 | S | 9/2012 | Christ | |
| 8,397,357 | B1 | 3/2013 | Madey | |
| 8,424,117 | B2 | 4/2013 | Hasan et al. | |
| 8,438,708 | B1 | 5/2013 | Tuck | |
| D705,535 | S | 5/2014 | Stapleton | |
| D806,997 | S | 1/2018 | Whiting | |
| 10,327,512 | B2 | 6/2019 | Birrell | |
| 10,405,603 | B2 | 9/2019 | Vallon et al. | |
| 10,548,371 | B2 * | 2/2020 | Bradley | A43B 1/08 |
| D887,694 | S | 6/2020 | Bradley | |
| D888,395 | S | 6/2020 | Bradley | |
| D928,489 | S | 8/2021 | Bradley | |
| 2002/0029494 | A1 | 3/2002 | Small | |
| 2006/0168850 | A1 | 8/2006 | Wartel et al. | |
| 2008/0301860 | A1 | 12/2008 | Iqbal | |
| 2009/0293240 | A1 | 12/2009 | Hubbard | |
| 2010/0018082 | A1 | 1/2010 | Stokes | |
| 2010/0224312 | A1 | 9/2010 | Tsubaki | |
| 2013/0269218 | A1 | 10/2013 | Blumenaus | |
| 2013/0333242 | A1 | 12/2013 | Whiting | |
| 2014/0338224 | A1 | 11/2014 | Sketch et al. | |
| 2014/0345158 | A1 | 11/2014 | Fox | |
| 2017/0027285 | A1 | 2/2017 | Mancini | |
| 2018/0084866 | A1 | 3/2018 | Bradley | |
| 2020/0113288 | A1 | 4/2020 | Bradley | |

OTHER PUBLICATIONS

Utcarible 5 Pairs Heel Cushion Inserts Heal Grips Shoe Pads for Women Non Slip Wear Resistant Silicone Heel Liners Protectors for Loose Shoes High Heels, https://www.walmart.com/ip/AUTCARIBLE-5-Pairs-Heel-Cushion-Inserts-Grips-Show-Pads-Woemn-Non-Slip-Wear-Resistent-Silicone-Liner-Protectors, 2021 (Year: 2021).

2021 Extra Grip Design Heel Cushion Pads—Shoe Heel Grip Pads—Shoe Back Heel Pads to Prevent Blisters, Calluses & Loose Shoes—Fit Most Shoes—Invisible (2 Pairs), https://www.ubuy.com.tr/eb/product/QX7WN34W-2021-extra-grip-design-heel-cushion-pads-shoe-heel-grip, May 26, 2021 (Year: 2021).

https://www.rogerscorp.com/elastomeric-material-solutions/poron-industrial-polyurethanes, Apr. 17, 2015.

https://www. sealanddesign.com/products/gaskets/foam-gaskets/urethane-foam-poron-material/, Apr. 17, 2015.

* cited by examiner

HEEL PAD HAVING A MALLEABLE MEMBER AND METHOD OF USE

REFERENCE TO RELATED APPLICATIONS

This application is a continuation of application Ser. No. 15/934,459, filed Mar. 23, 2018, entitled "HEEL PAD HAVING A MALLEABLE MEMBER AND METHOD OF USE" which is a continuation-in-part of application Ser. No. 15/566,162, filed Oct. 12, 2017, entitled "HEEL PAD HAVING A MALLEABLE MEMBER AND METHOD OF USE". Application Ser. No. 15/566,162 is a § 371 National Phase application of International Application No. PCT/US2016/026606, filed Apr. 8, 2016, which claims the benefit under 35 USC § 119(e) of the U.S. provisional application No. 62/148,942, filed on Apr. 17, 2015. The aforementioned applications are hereby incorporated herein by reference.

BACKGROUND OF THE INVENTION

Field of the Invention

The invention pertains to the field of heel pads for shoes. More particularly, the invention pertains to a heel pad having a malleable member.

Description of Related Art

A variety of insert pads are known for use with shoes. Many of the known insert pads are used underneath a wearer's foot for absorbing shock or odors.

Typically, an insert pad is placed along a top surface of a sole of a shoe. This allows for a wearer to comfortably place his/her foot over the insert pad.

While known insert pads resolve shock and odor problems, they do not necessarily solve other shoe related problems such as irritation and chafing to a wearer's foot (particularly the heel of the foot). There are certain types of shoes that tend to cause this irritation and chafing such as dress shoes, athletic shoes, and high heeled shoes. For example, a high-heeled shoe tends to cause irritation to the wearer's foot due to a heel of the shoe digging in and rubbing against the wearer's heel.

A known solution to these irritation and chafing problems is a heel pad. The heel pad is positioned within a heel section of a shoe. In particular, the heel pad is typically a narrow-shaped pad that is positioned along an inner surface of the heel counter of the shoe. The heel pad provides a comfortable fit between a wearer's heel and the shoe thus limiting friction between the wearer's heel and the shoe. This can result in less irritation and chafing on the wearer's heel (thus eliminating the formation of blisters and calluses).

In one example, the heel pad includes a gel substance for comfortably fitting around a wearer's heel. The gel heel pad typically includes an adhesive strip for anchoring the gel heel pad along the inner surface of the heel counter of the shoe.

Another example heel pad includes a urethane material (e.g., Poron® urethane microporous material available from Rogers Corporation of Rogers, Conn.) for providing a comfortable fit around the wearer's heel. Similar to the gel heel pad, this urethane heel pad includes an adhesive strip for anchoring the urethane heel pad to the inner surface of the heel counter of the shoe.

SUMMARY OF THE INVENTION

The known heel pads experience some shortcomings. For example, the known heel pads do not stay firmly in the heel counters of shoes, in particular, the adhesive strip of each known heel pad does not provide adequate adhesion with respect to anchoring the heel pads in the shoes. This is the result of the adhesive strips losing their adhesion properties over time and in some cases shortly after first use. Thus, the known heel pads tend to shift position during use or the heel pads detach completely from the heel counters of shoes. In addition, due to their typically narrow shape, known heel pads do not provide adequate amount of coverage to protect the entire heel of a wearer's foot. Also, the narrow shape of known heel pads translates into less cushioning material being incorporated within the heel pads.

The present invention is directed toward solutions to address these needs, in addition to having other desirable characteristics. Specifically, the present invention heel pad includes a malleable member that allows the heel pad to adequately maintain its position within a heel section of a shoe. In particular, the malleable member functions to anchor the heel pad directly to the shoe such that the heel pad securely maintains its position in the shoe. In one example, the present invention heel pad uses the malleable member to affix itself to an outer surface of the heel section of the shoe for fastening the heel pad in place. Furthermore, the present invention heel pad is configured to provide adequate coverage for protecting the entire heel area of a wearer's foot.

In general, according to one aspect, the invention features a heel pad for placement within a shoe. The heel pad includes a pliable body, a filler element contained within the pliable body, and a malleable member fastened within the pliable body and extending along at least part of a length of the pliable body.

The malleable member is typically fastened to the pliable body with stitching. In one example, the malleable member includes a metal material. In another example, the malleable member includes metal material inserted within a fabric covering.

The pliable body has a shape configured to fit the back of a wearer's heel. In one example, the pliable body is constructed from a fabric sheet.

The filler element typically includes a material having soft, flexible, and moldable properties. The filler element can include a polyester pile, beads, foam, multiple sheets of polyester, microfiber, or gel.

In one embodiment, a shoe side of the pliable body is mounted to an inner surface of a heel section of the shoe such that the heel pad is integrated with the heel section of the shoe. In another embodiment, a shoe side of the pliable body is releasably attached to an inner surface of a heel section of the shoe using a fastener such that the heel pad is attached and detached from the heel section of the shoe.

The invention features an article of footwear that includes a shoe having an insole coupled to a heel section that includes a heel pad positioned in the heel section of the shoe. The heel pad has a pliable body, a filler element contained within the pliable body, and a malleable member fastened within the pliable body and extending along at least part of a length of the pliable body. The malleable member is bent to fold a longitudinal end of the pliable body along an upper edge of the heel section of the shoe and affix the end of the pliable body to an outer surface of the heel section of the shoe.

In one embodiment, the article of footwear includes an extender heel pad. The extender heel pad can include a pliable body having a filler element therein. In one example, the pliable body of the extender heel pad has a generally hemispherical shape. The extender heel pad is positioned along part of a foot side of the heel pad.

In one embodiment, the extender heel pad is mounted to part of the foot side of the heel pad and a shoe side of the heel pad is mounted to an inner surface of the heel section of the shoe such that the heel pad and extender heel pad are integrated with the heel section of the shoe. In another embodiment, the extender heel pad is mounted to part of the foot side of the heel pad and a shoe side of the heel pad is mounted to an inner surface of the heel section of the shoe such that the extender heel pad is attached and detached from the heel pad and the heel pad is attached and detached from the inner surface of the heel section of the shoe.

The invention also features a method of using a heel pad for a shoe. The method includes providing the heel pad having a pliable body, a filler element contained within the pliable body, and a malleable member fastened within the pliable body and extending along at least part of a length of the pliable body. The heel pad is positioned along an inner surface of a heel section of the shoe. A longitudinal end of the heel pad is folded along an upper edge of the heel section of the shoe. The folded longitudinal end of the heel pad is affixed to an outer surface of the heel section of the shoe.

In another embodiment, the heel pad inserted into the shoe has a pliable body having a first end, a second end, a length extending between the first end and the second end, a foldable portion between the first end and the second end and a first flap and a second flap extending from the foldable portion to the second end. A first malleable member is fastened within the first flap of the pliable body with the first malleable member extending a length from the second end to the foldable portion. A second malleable member is fastened within the second flap of the pliable body with the second malleable member extending a length from the second end to the foldable portion. A filler element is also contained within the pliable body at the first end to create a pad portion.

In yet another embodiment, the heel pad inserted into the shoe has a pliable body having a first end, a second end, a length extending between the first end and the second end, a foldable portion between the first end and the second end and a first flap and a second flap extending from the foldable portion to the second end. A filler element is contained within the pliable body at the first end to create a pad portion. A first malleable member is fastened within the first flap of the pliable body with the first malleable member extending a length from the second end to the pad portion of the pliable body. A second malleable member is fastened within the second flap of the pliable body with the second malleable member extending a length from the second end to the pad portion of the pliable body. By having the first and second malleable members extend through the foldable portion, the heel pad is alterable to fit various lengths of nonstandard heel counters of shoes.

The heel pad can be of various lengths to accommodate different lengths and widths of the heel sections of different shoes, regardless of the actual heel height of the shoe.

The first and second malleable members allows the heel pad to be moldable to a heel counter of multiple heights.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE INVENTION

Figure 1:
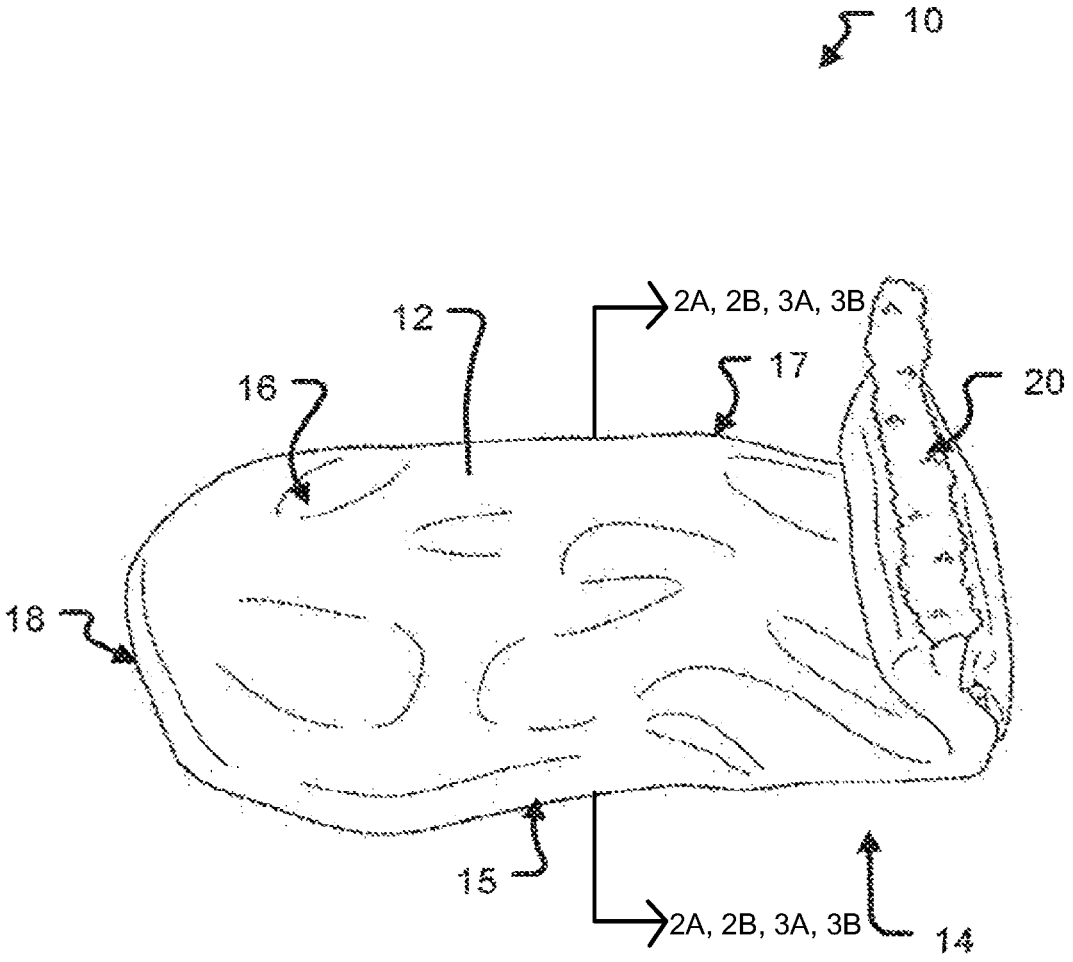
FIG. 1 is a perspective view of a heel pad.

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms of the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

In the present invention, the heel pads of embodiments of the present invention are placed on an inner surface of a heel counter of a shoe. The inner surface of the heel counter varies amongst shoes, but is often of a standard length or less, or a greater nonstandard length. The heel pads of the embodiments of the present invention can be used with shoes which have a heel counter of a standard length and a nonstandard length. The standard length of the heel counter is preferably approximately 5 cm or less and a nonstandard length of the heel counter is greater than approximately 5 cm. The length of the heel counter may or may not correspond to heel height of the shoe. It should be noted that the lengths shown for the inner surface of the heel counter even though designated that same reference number may vary based on the perspective of the drawing being shown.

FIG. 1 illustrates a heel pad 10. The heel pad 10 is placed within a shoe for protecting a wearer's ankle or heel from abrasion and discomfort (typically caused by friction between the wearer's heel and the inside surface of the shoe).

The heel pad 10 can be sized to fit a variety of different shoes as appreciated by one of skill in the art.

The heel pad 10 has a length stretching from a first end 18 to a second end 20 that can be increased or decreased to fit a variety of different shoes as appreciated by one of skill in the art. Relative to an average heel pad length, the heel pad length is designed to be shorter for the shoe with a standard length or less heel counter whereas the heel pad length is designed to be longer for the shoe with a nonstandard length heel counter. For example, the heel pad 10 has a relatively long and narrow shape for the nonstandard length heel counter whereas the heel pad 10 has a relatively short and wide shape to accommodate a standard length or less than standard length heel counter. In examples, the heel pad 10 has a total length (from the first end 18 to the second end 20 and measured at max length of shape) between about 9 cm and about 12 cm. The heel pad 10 has a total width (from a first side 15 to a second side 17 and measured at max width of shape) between about 3.5 cm and about 5.5 cm that extends in parallel with a 2A, 2B, 3A, 3B-2A, 2B, 3A, 3B axis. The heel pad 10 can be designed with other measurements as appreciated by one of skill in the art in order to accommodate other shoe types.

The heel pad 10 includes a foot side 14 for receiving the heel of a wearer's foot. The heel pad 10 includes a shoe side 16 for placement against an inside surface of a shoe.

The heel pad 10 includes a pliable body 12 forming a shape of the heel pad 10. The pliable body 12 is shaped to fit the back of a wearer's heel. In particular, the pliable body 12 tapers at the first end 18 to fit the back of the wearer's heel. The pliable body 12 has a generally ovoid shape, in other examples, the pliable body 12 has a triangular shape, polygonal shape, rectangular shape, square shape, or other shape as appreciated by one of skill in the art.

The pliable body 12 can be constructed from a variety of materials. For example, the pliable body 12 can be constructed from one or more layers of cotton, soft leather, suede, micro suede, neoprene, polyester, or other materials as appreciated by one of skill in the art. The materials can be white in color as illustrated. In one embodiment, materials may be selected such that the color of the pliable body 12 matches and blends in with the color of the shoe. In still another embodiment, materials may be selected to produce a pattern and/or an image on the pliable body 12. Materials may be selected to produce other colors and/or designs for the pliable body 12 as appreciated by one of skill in the art.

Figure 2A:
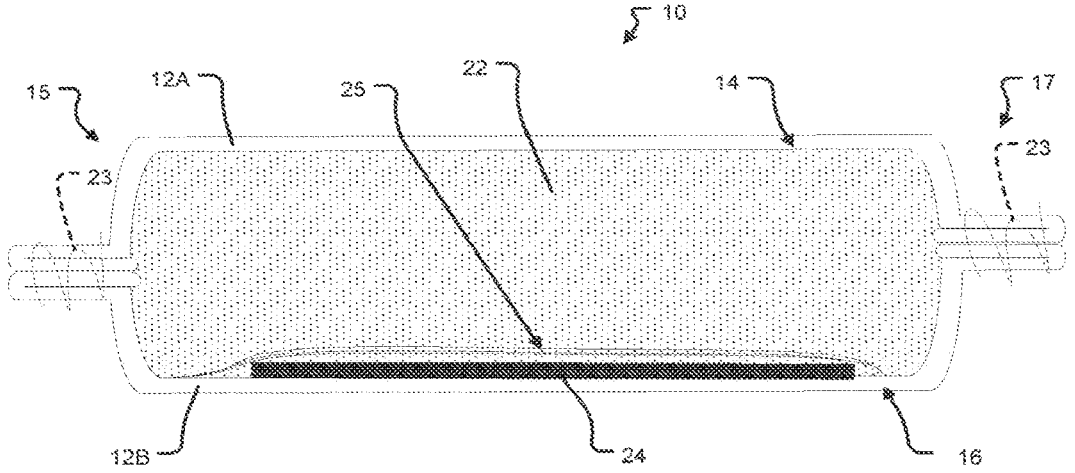
FIG. 2A is a cross-sectional view along a 2A-2A axis of the heel pad of FIG. 1 according to one embodiment of the present invention.
Figure 2B:
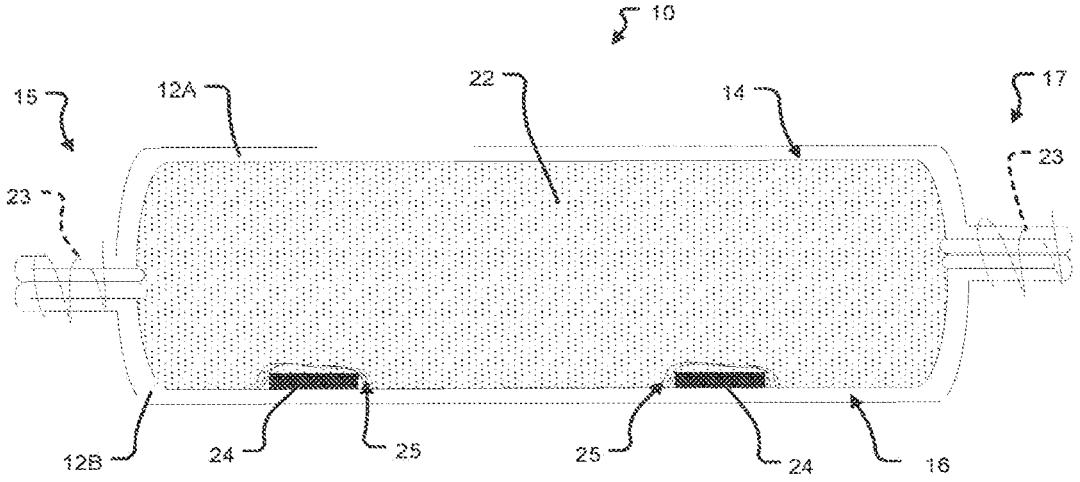
FIG. 2B is a cross-sectional view along a 2B-2B axis of the heel pad of FIG. 1 according to another embodiment of the present invention.

FIGS. 2A and 2B illustrate two cross-section embodiments of the heel pad 10. Both cross-sections are viewed along the 2A, 2B, 3A, 3B-2A, 2B, 3A, 3B line of FIG. 1.

As illustrated in the cross-sections, the pliable body 12 is constructed from two fabric layers 12A, 12B. Each fabric layer 12A/12B is folded on two opposing sides (first side 15 and second side 17). As shown, the upper fabric layer 12A is folded over itself at the first side 15 and folded over itself at the second side 17. Similarly, the lower fabric layer 12B is folded over itself at the first side 15 and folded over itself at the second side 17. The fabric layers 12A, 12B are stitched together at these folded sides using body stitching 23 (e.g., fabric stitching). In particular, the folded sides of the upper fabric layer 12A are stitched directly to the folded sides of the lower fabric layer 12B forming a seam along the body stitching 23. The upper fabric layer 12A is the foot side 14 of the pliable body 12 and the lower fabric layer 12B is the shoe side 16 of the pliable body 12.

In another example, the pliable body 12 can be constructed from a single fabric sheet.

The heel pad 10 includes a filler element 22 contained within the pliable body 12 (i.e., between the upper fabric layer 12A and the lower fabric layer 12B). It should be noted that the amount of filler element 22 is not limited to the amount shown in the Figures. The filler element 22 typically includes a material that generally has soft, flexible, and moldable properties. For example, the filler element 22 can include a polyester pile, beads, multiple sheets of polyester, microfiber, gel, foam, feathers, silk, linen, rubber, synthetic plastic, rigid paper or other materials as appreciated by one of skill in the art.

The heel pad 10 includes a malleable member 24. The malleable member 24 is fastened within the pliable body 12 and extends along at least part of the length of the pliable body 12 as well as at least part of the width of the pliable body 12. In FIGS. 2A and 2B, the malleable member 24 is fastened to the pliable body 12 by using member stitching 25 (e.g. plastic stitching).

FIG. 2A illustrates an embodiment where the heel pad 10 includes one malleable member 24 extending along the width (between the first side 15 and the second side 17) of the pliable body 12. Member stitching 25 is used to fasten the malleable member 24 proximate to the lower fabric layer 12B of the pliable body 12.

In FIG. 2B, the heel pad includes two malleable members 24 that each separately extend along part of the width of the pliable body 12. Separate member stitching 25 is used to fasten the two malleable members 24 proximate to the lower fabric layer 12B of the pliable body 12.

The malleable member 24 is constructed of a material having "malleable" properties. "Malleable" properties include the ability to hammer or press the material permanently out of shape without breaking or cracking the material. The "malleable" properties typically relate to metals that can be permanently bent and twisted into a variety of shapes without breaking. Examples of "malleable" metals can include gold, silver, aluminum, copper, tin, lead, zinc, iron, and other related alloys. A material having "malleable" properties is able to be bent into one shape such that the material maintains this shape until a new force is applied to bend the material into a different shape. Thus, for example, the "malleable" material can be bent permanently into a first shape and then bent permanently into a second shape different from the first shape. The term "malleable" and particularly the terms "malleable member" are to be interpreted throughout the specification based on this definition of "malleable" properties.

Figure 3A:
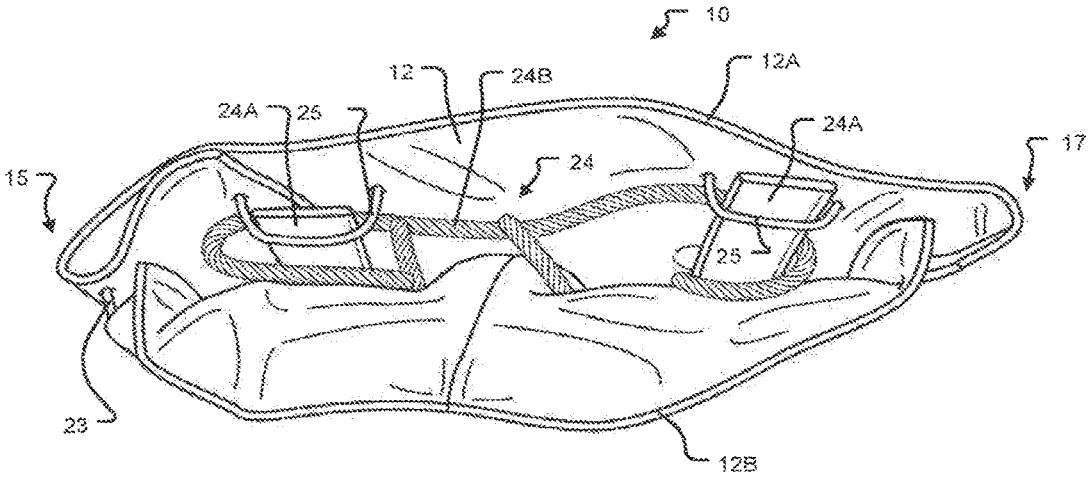
FIGS. 3A and 3B are cross-sectional views along, respectively, a 3A-3A and 3B-3B axis of the heel pad of FIG. 1 without and with a filler element according to another embodiment of the present invention.
Figure 3B:
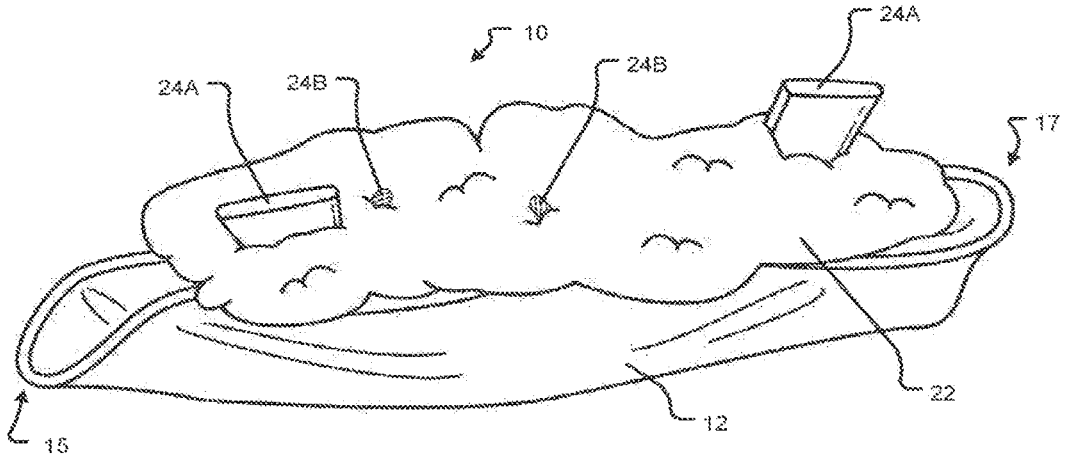

FIGS. 3A and 3B illustrate cross-sections of the heel pad 10 according to another embodiment. Similar to FIGS. 2A-2B, the heel pad 10 includes the pliable body 12 constructed from two fabric layers 12A, 12B. The heel pad 10 is shown without the filler element 22 (FIG. 3 A) and with the filler element 22 (FIG. 3B). In the FIG. 3B example, the filler element 22 is polyester pile. The heel pad 10 also includes the malleable member 24 according to another example.

As illustrated in FIGS. 3A and 3B, this example malleable member 24 includes multiple components forming a specific arrangement. The malleable member 24 is composed of two metal plates 24A and metal wiring 24B. The metal plates 24A are tied to one another by the metal wiring 24B forming the malleable member 24. This malleable member 24 (i.e., metal plates 24A and metal wiring 24B) is fastened to the pliable body 12 with the member stitching 25. In other examples, the metal wiring 24B can be welded, soldered, brazed, riveted (e.g., using needles through wiring and plates), or glued to the two metal plates 24A.

Figure 4A:
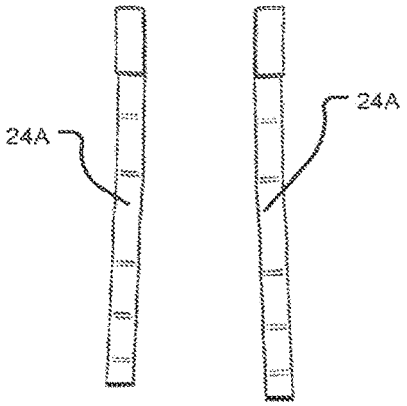
FIG. 4A is a perspective view of a malleable member according to one embodiment of the present invention.
Figure 4B:
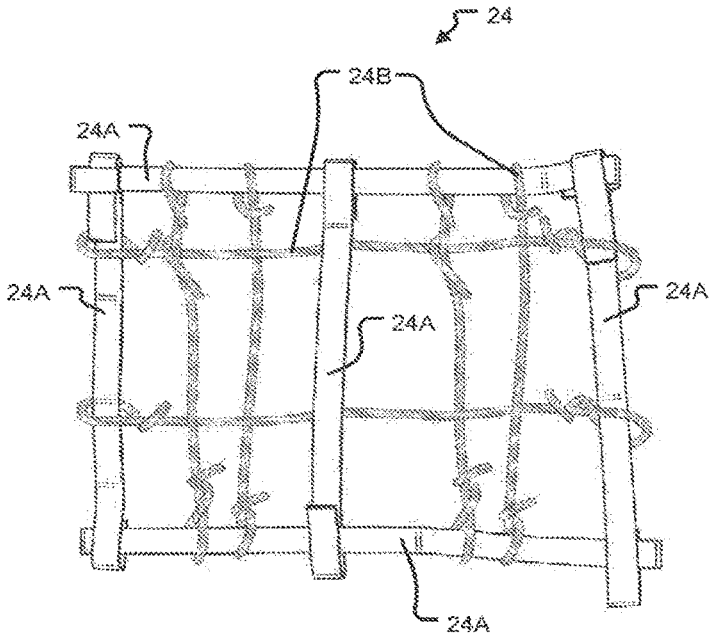
FIG. 4B is a perspective view of the malleable member according to another embodiment.
Figure 4C:
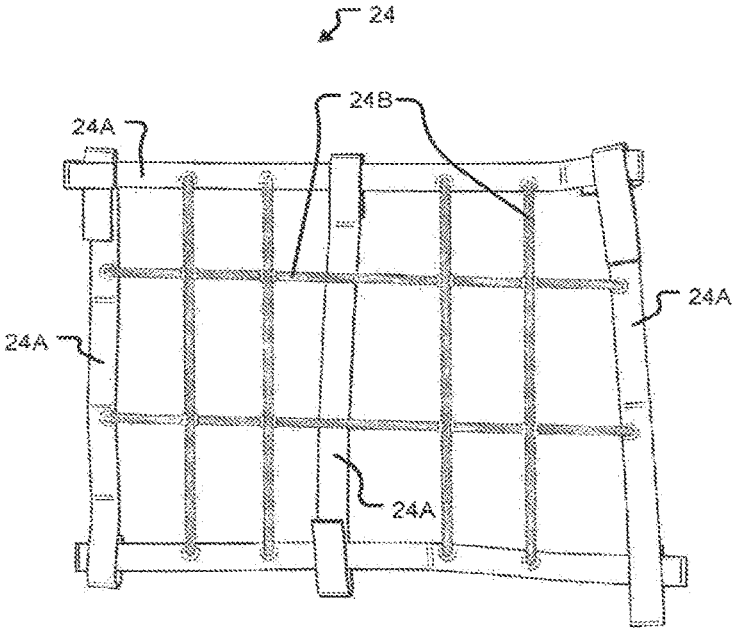
FIG. 4C is a perspective view of the malleable member according to another embodiment.

FIGS. 4A-4C illustrate other embodiments of the malleable member 24.

In FIG. 4A, the malleable member 24 is in the form of one metal plate 24A. In this example, each metal plate 24A (i.e., each malleable member 24) is separately stitched to the pliable body 12 using member stitching 25 as illustrated in FIG. 2B. In another example, the two metal plates 24A can be held together by metal wiring 24B that is tied to the two metal plates 24A as illustrated in FIG. 3A. The combined two metal plates 24A with metal wiring 24B form the malleable member 24. This malleable member 24 is stitched to the pliable body 12 using member stitching 25.

In FIG. 4B, the malleable member 24 includes five metal plates 24A held together by metal wiring 24B. Four of the five metal plates 24A are clipped together to form a generally rectangular shape. In particular, each metal plate 24A is clipped onto an end of a different metal plate 24A. The four metal plates 24A are clipped to one another to form the rectangular shape. The four metal plates 24 A can be further welded, soldered, brazed, riveted, or glued to one another to form the rectangular shape. One metal plate 24A is clipped across the center of the rectangular shape such that this metal plate 24A is perpendicular to the length of the rectangular shape. This central metal plate 24A can be further welded, soldered, brazed, riveted, or glued to the other metal plates 24A. As illustrated in FIG. 4B, the malleable member 24 includes metal wiring 24B that crosses the length of the rectangular shape as well as across the width of the rectangular shape. In this example, a first pair of metal wiring 24B is tied (e.g., with a knot) and fastened on the metal plate 24A forming a vertical side of the rectangular shape and then tied and fastened to the metal plate 24A forming an opposite vertical side of the rectangular shape. A second pair and a third pair of metal wiring 24B are tied and fastened on the metal plate 24A forming a horizontal side of the rectangular shape and then tied and fastened to the metal plate 24A forming an opposite horizontal side of the rectangular shape. The metal wiring 24B provides additional support in holding the metal plates 24A to one another.

FIG. 4C depicts the same malleable member 24 illustrated in FIG. 4B except the metal wiring 24B is welded to the metal plates 24A and other metal wiring 24B. As appreciated by one of skill in the art, the metal wiring 24B can be soldered, brazed, riveted, or glued to the other metal wiring 24B and the metal plates 24A.

The malleable member 24 can include additional metal clips for holding the metal plates 24A to one another. For example embodiments including multiple metal plates 24A, the additional metal clips can be attached or clamped to the ends of the metal plates 24 for providing further support in keeping the metal plates 24A together.

The metal plates 24A described above can include aluminum, copper, or another metal or metal alloy that has "malleable" properties as appreciated by one of skill in the art. The metal wiring 24B can include aluminum, copper, or another metal or metal alloy that has "malleable" properties as appreciated by one of skill in the art. In general, the metal plates 24A and metal wiring 24B can vary in terms of type, size, and thickness as appreciated by one of skill in the art.

Figure 5A:
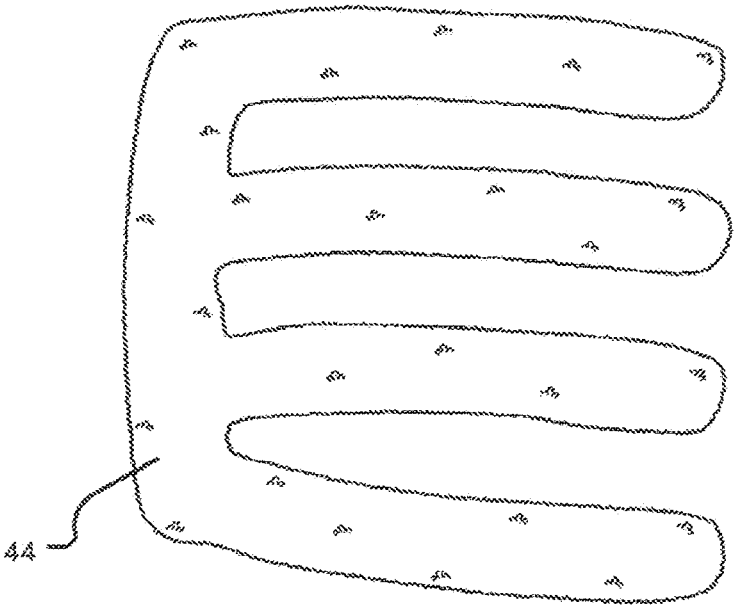
FIG. 5A is a perspective view of a fabric covering for the malleable member.

FIG. 5A illustrates a fabric covering 44 for the metal plates 24A (i.e., malleable members 24) of FIG. 4A. The fabric covering 44 includes multiple strands. The fabric covering 44 can include cotton material having a feathery texture. The fabric covering 44 can include other materials for providing properties of a soft fabric surface as appreciated by one of skill in the art.

Figure 5B:
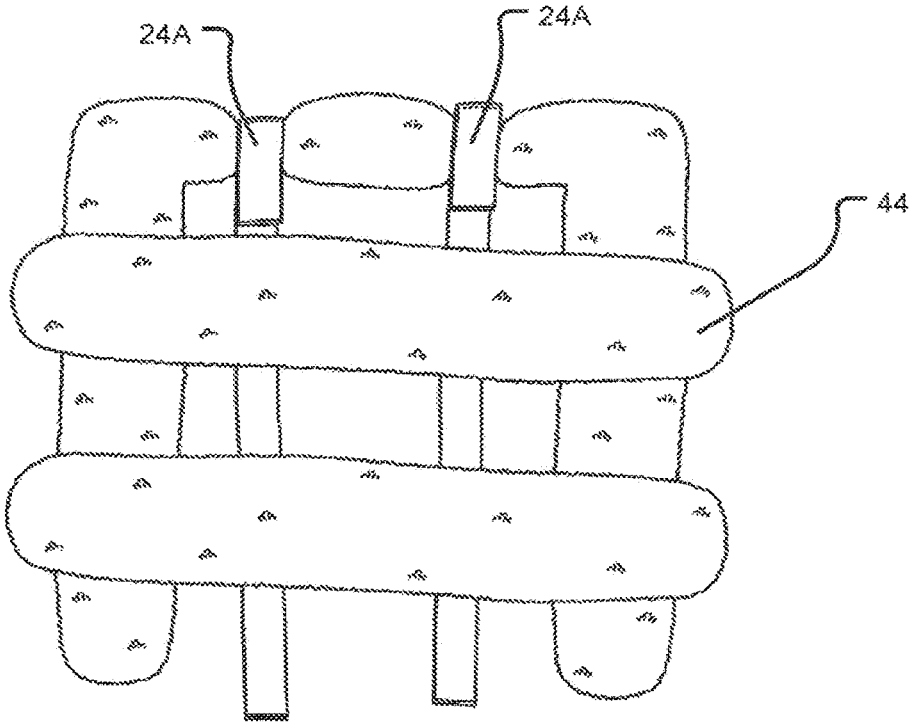
FIG. 5B is a perspective view of the fabric covering of FIG. 5A wrapped around portions of the malleable member of FIG. 4A.

FIG. 5B illustrates the metal plates 24A (i.e., malleable members 24) inserted within the fabric covering 44. In particular, the fabric covering 44 is wrapped around portions of the metal plates 24A. The fabric covering 44 provides a soft external surface around portions of the metal plates 24A. This provides additional comfort to a wearer that uses the heel pad 10.

In other examples, the fabric covering 44 can be used to cover the malleable member 24 illustrated in FIG. 4B or the malleable member 24 illustrated in FIG. 4C.

Figure 6A:
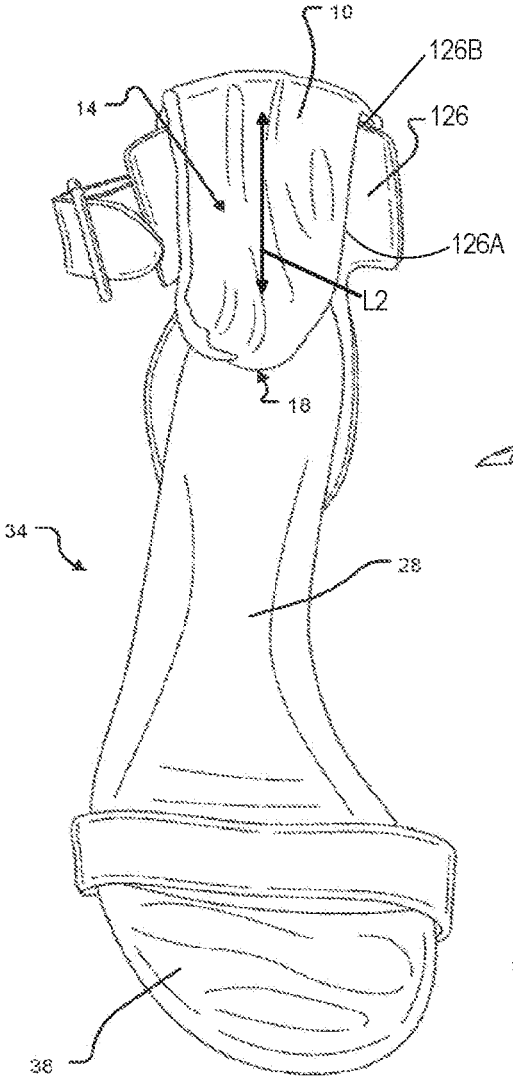
FIG. 6A is a front perspective view of the heel pad positioned in a shoe.
Figure 6B:
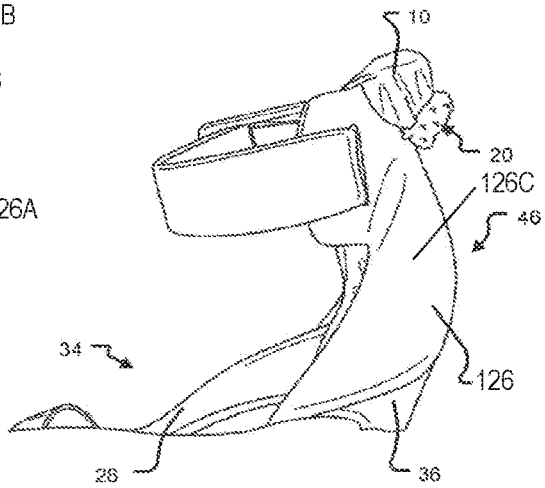
FIG. 6B is a partial side perspective view of the heel pad positioned in the shoe of FIG. 6A.
Figure 6C:
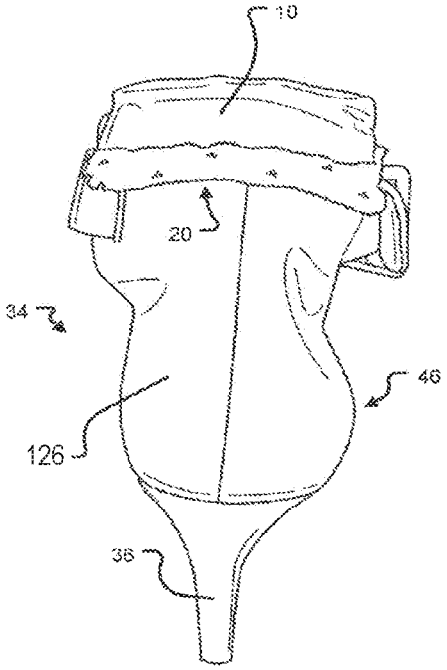
FIG. 6C is a back perspective view of the heel pad positioned in the shoe of FIG. 6A.

FIGS. 6A, 6B, and 6C illustrate use of the heel pad 10 in shoe 34 with an inner heel counter 126 of a nonstandard heel counter length L2. The shoe 34 includes an insole 28 coupled between a heel section 46 and a toe box 38. The heel section 46 includes a heel 36 attached below the heel counter 126. The heel pad 10 is positioned along an inner surface of the heel counter 126. In addition to the high heeled shoe 34, the heel pad 10 may be used with casual shoes, sneakers, boots, sports shoes, ice skates, cross trainer shoes, cleats, ski boots, sandals, flats, or other shoes as appreciated by one of skill in the art.

The malleable member 24 allows the heel pad 10 to be bent or folded in different configurations. As illustrated in FIGS. 6A-6C, the heel pad 10 is folded over the heel counter 126. In particular, the first end 18 of the heel pad 10 is positioned along the inner surface 126A of the heel counter 126 and the second end 20 (i.e., longitudinal end) of the heel pad 10 is folded along an upper edge 126B of the heel counter 126. The second end 20 of the heel pad 10 is affixed to an outer surface 126C of the heel counter 126 of the shoe 34.

FIGS. 6A, 6B, and 6C illustrate different views (front view, side view, and back view) of the heel pad 10 positioned in and folded over the heel counter 126. In one example, a portion of the heel pad 10 that folds along the upper edge 126B of the heel counter 126 down to the outer heel counter 126C has a length between about 2.5 cm and about 4.5 cm depending on where the heel pad 10 is folded.

The heel pad 10 can be supplemented with an extender heel pad 30. The additional extender heel pad 30 expands the coverage area and length of the heel pad 10. This results in an extension of the length of coverage for padding the wearer's heel.

Figure 7:
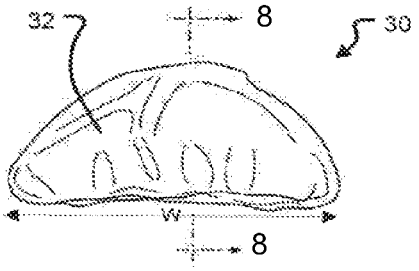
FIG. 7 is a perspective view of an extender heel pad.
Figure 8:
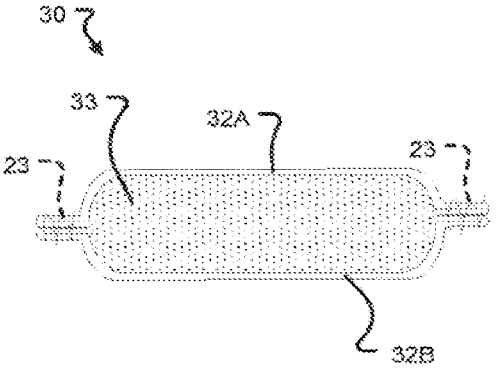
FIG. 8 is a cross-sectional view of the extender heel pad of FIG. 7 along the 8-8 axis.

FIG. 7 is a perspective view of the extender heel pad 30 and FIG. 8 is a cross-sectional view along an 8-8 axis of the extender heel pad 30. As shown, the extender heel pad 30 includes an extender pliable body 32 having an extender filler element 33 therein. In this example, the extender pliable body 32 has a generally hemispherical shape. In other examples, the extender pliable body 32 has a triangular shape, polygonal shape, rectangular shape, square shape, or other shape as appreciated by one of skill in the art.

Similar to the heel pad 10, the extender pliable body 32 is constructed of two fabric layers 32A, 32B. Each fabric layer 32A/32B is folded over itself on two opposing sides. The fabric layers 32A, 32B are stitched together at these folded sides using body stitching 23 (e.g., fabric stitching). In particular, the folded sides of the upper fabric layer 32A are stitched directly to the folded sides of the lower fabric layer 32B forming a seam along the body stitching 23. In another example, the extender pliable body 32 may be constructed from a single fabric sheet as appreciated by one of skill in the art.

The extender pliable body 32 can be constructed from a variety of materials. For example, the extender pliable body 32 can be constructed from one or more layers of cotton, soft leather, suede, micro suede, neoprene, polyester, or other materials as appreciated by one of skill in the art.

The extender heel pad 30 includes an extender filler element 33 contained within the extender pliable body 32 (i.e., between the upper fabric layer 32A and the lower fabric layer 32B). The extender filler element 33 typically includes a material that generally has soft, flexible, and moldable properties. For example, the extender filler element 33 can include a polyester pile, beads, multiple sheets of polyester, microfiber, gel, foam, feathers, silk, linen, rubber, synthetic plastic, or other materials as appreciated by one of skill in the art.

Figure 9:
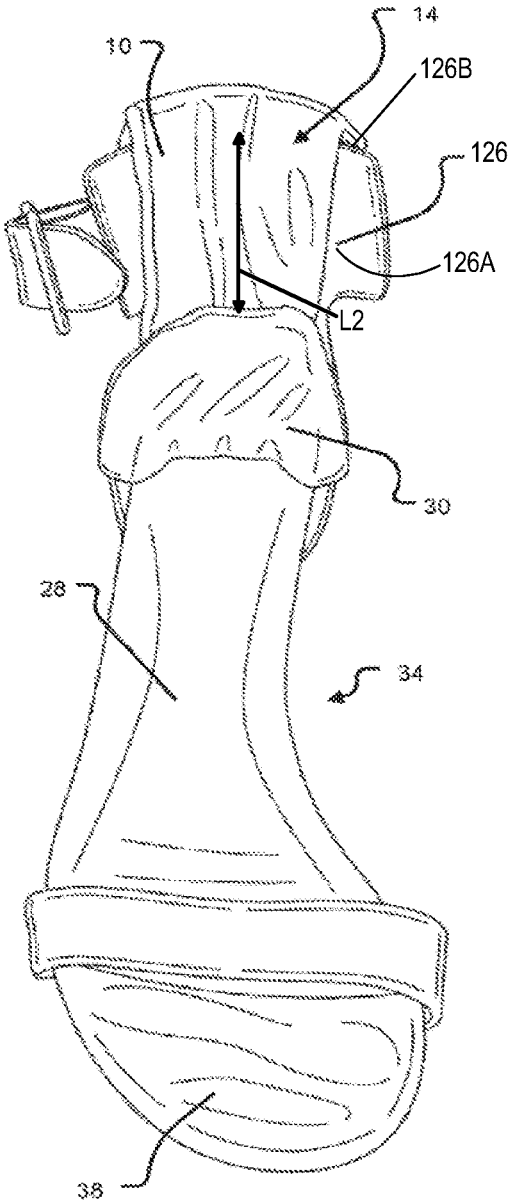
FIG. 9 is a front perspective view of the heel pad and extender heel pad positioned in the shoe of FIG. 6A.

In use, as illustrated in FIG. 9, the extender heel pad 30 is positioned over the heel pad 10. For example, the heel pad 10 is affixed or hooked onto the heel counter 126 of the shoe 34 which has a heel counter length that is nonstandard length, length L2. The extender heel pad 30 is positioned along part of the foot side 14 of the heel pad 10. Placing the extender heel pad 30 over the heel pad 10 provides additional padding and extends the length of the heel pad 10 for the shoe 34.

In another example, the heel pad 10 is positioned over the extender heel pad 30. In this example, the extender heel pad 30 is positioned along the inner surface 126A of the heel counter 126. Then, the shoe side 16 of the heel pad 10 is positioned along part of the extender heel pad 30. The heel pad 10 is affixed or hooked onto the heel counter 126 (i.e., folded along the upper edge 126B of the heel counter 126).

The extender heel pad 30 can have various dimensions. In one example, the extender heel pad 30 has a width W (perpendicular to 8-8 and measured at max width of hemispherical shape) between about 3.5 cm and about 5.5 cm. In this same example, the extender heel pad 30 has a length (along 8-8 and measured at max length of hemispherical shape) between about 3 cm and about 4 cm. Other length and width measurements may be used for the extender heel pad 30 as appreciated by one of skill in the art.

The heel pad 10 can include a fastener for attaching the heel pad 10 within a shoe. The fastener provides additional support in maintaining the heel pad 10 within the shoe (i.e., assist in keeping the heel pad 10 in place). For example, the shoe side 16 of the heel pad 10 is releasably attached to the inner surface 26A of the heel counter 26 of the shoe 35 using the fastener such that the heel pad 10 is attached and detached from the heel counter 26 of the shoe 35.

Figure 10:
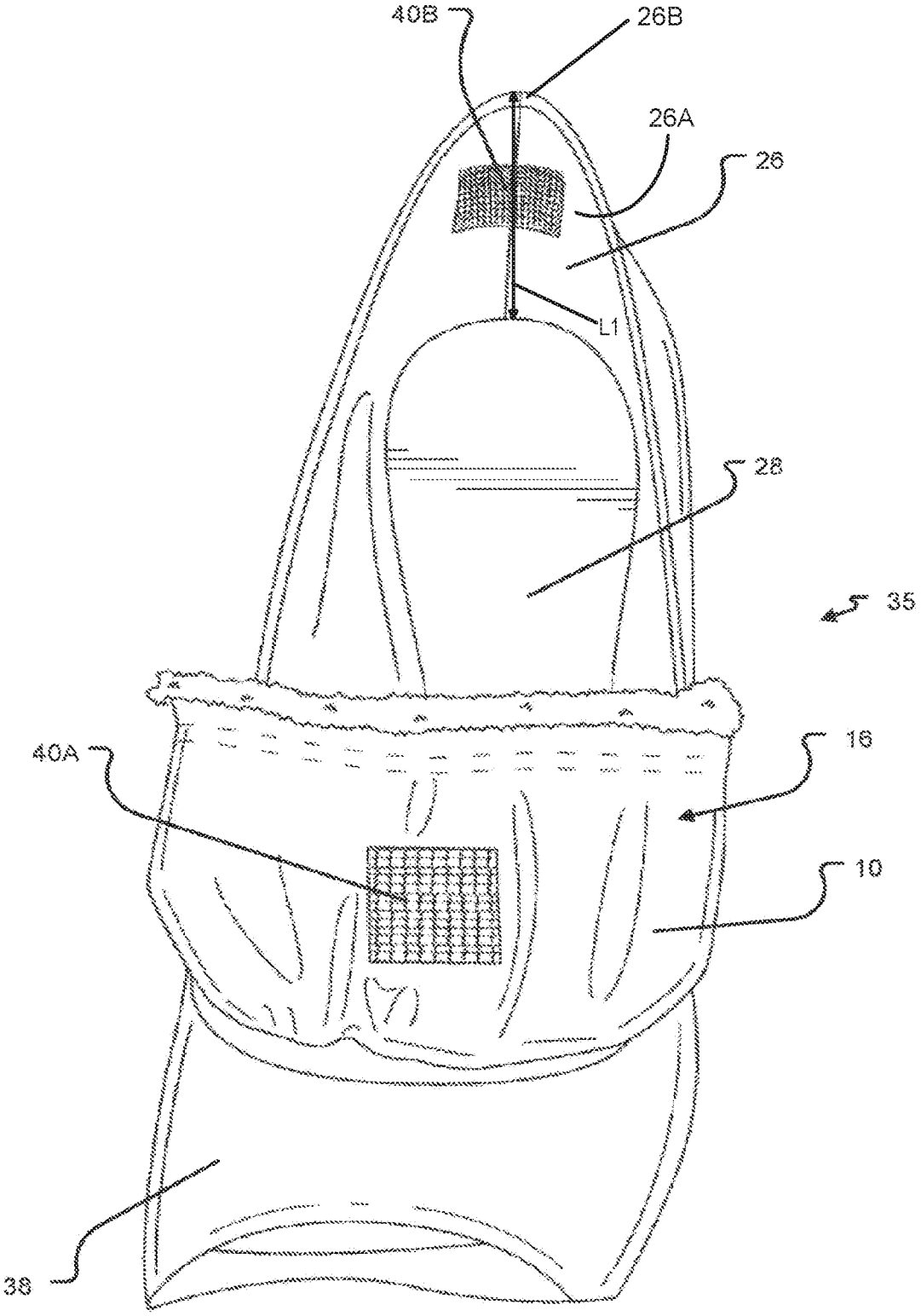
FIG. 10 is a partial perspective view of the heel pad having a fastener for attaching the heel pad within a shoe according to an embodiment of the present invention.

In FIG. 10, the heel pad 10 utilizes a hook and loop type of fastener for attaching the heel pad 10 within a shoe 35 that has a heel counter that has a length L1 which is less than the nonstandard length heel counter L2. The heel pad 10 can also utilize this hook and loop type of fastener with shoe 34. In particular, the shoe side 16 of the heel pad 10 includes a hook fastener section 40A which releasably attaches to or detaches from a loop fastener section 40B on the inner surface 26A, 126A of the heel counter 26, 126 of the shoe 34, 35.

The heel pad 10 can be adhered into the shoe 34, 35 using a different fastener such as an adhesive strip (e.g., peel and stick type of adhesive). In one example, the adhesive strip is placed on the shoe side 16 of the heel pad 10 and the heel pad 10 is attached to the heel counter 26, 126 using the adhesive strip. In another example, one adhesive strip is placed on the shoe side 16 of the heel pad 10 and a complementary adhesive strip is placed on the inner surface 26A, 126A of the heel counter 26, 126. The heel pad 10 is attached to the heel counter 26, 126 using these complementary adhesive strips.

The heel pad 10 can use other fastening means such as sewing, tacking, riveting, button fasteners, magnetic fasteners, or other adhesive mechanisms for providing additional support in attaching the heel pad 10 into the heel counter 26, 126 as appreciated by one of skill in the art.

In one example, the heel pad 10 is inserted with the shoe 34, 35. In particular, the shoe side 16 of the heel pad 10 is mounted to the inner surface 26A, 126A of the heel counter 26, 126 of the shoe 34, 35 such that the heel pad 10 is integrated with the heel counter 26, 126. For this integrated example, the pliable body 12 of the heel pad 10 can be constructed from a layer of the same material as the inner surface of the heel counter 26, 126. In another example, the pliable body 12 is constructed of a material that is different from the inner surface of the heel counter 26, 126.

In another example, the extender heel pad 30 is mounted to the heel pad 10 using a fastener. For example, the extender heel pad 30 can include a hook fastener section 40A that is mounted to a loop fastener section 40B on the foot side 14 of the heel pad 10. The extender heel pad 30 can use other fastening means such as adhesive, sewing, tacking, or riveting for attaching the extender heel pad 30 to the heel pad 10 as appreciated by one of skill in the art.

In a further example, the combination of the extender heel pad 30 and the heel pad 10 are inserted into shoe 34. In this integrated example, the extender heel pad 30 is mounted to part of the foot side 14 of the heel pad 10 and the shoe side 16 of the heel pad 10 is mounted to the inner surface 126A of the heel counter 126 such that the heel pad 10 and extender heel pad 30 are integrated with the heel counter 126 of the shoe 34. The pliable body 12 of the heel pad 10 and the pliable body 32 of the extender heel pad 30 can be constructed from a layer of the same material as the inner surface of the heel counter 126. In another example, the pliable bodies 12, 32 are constructed of a material that is different from the inner surface of the heel counter 126.

Figure 11:
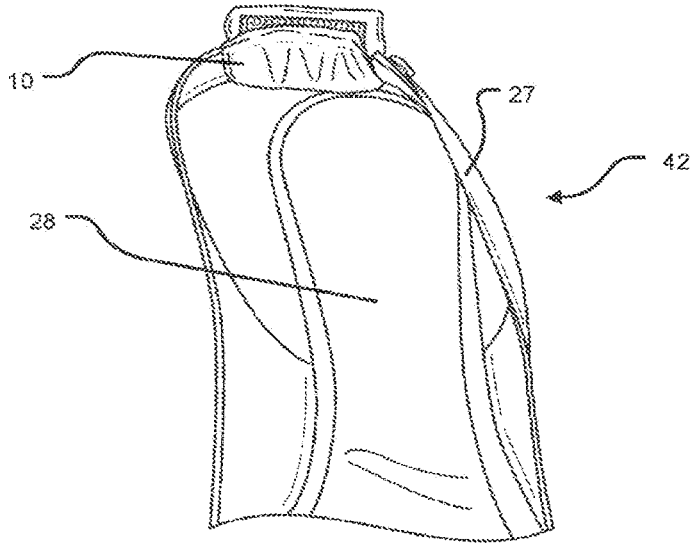
FIG. 11 is a partial perspective view of a wrapped heel pad using a fastener to attach the heel pad within a shoe according to another embodiment of the present invention.

FIG. 11 illustrates an example embodiment of the heel pad 10 in use with a slingback shoe 42. The slingback shoe 42 is a woman's type of shoe characterized by a heel strap 27 that crosses behind the heel of the wearer's foot. The heel strap 27 completely encircles the wearer's heel. The slingback shoe 42 can encompass casual and dressy shoes with a range of heel heights.

In use, as illustrated in FIG. 11, the heel pad 10 is wrapped around the heel strap 27 of the slingback shoe 42. This wrapped form of the heel pad 10 provides comfort to the wearer's heel by eliminating frictional contact between the wearer's heel and the heel strap 27.

For this embodiment, the heel pad 10 is attached to the heel strap 27 and the heel pad 10 attaches to itself in order to wrap around the heel strap 27. The heel pad 10 includes a fastener (either a hook fastener section 40A or a loop fastener section 40B) centrally located on the shoe side 16 of the heel pad 10. This centrally located fastener on the heel pad 10 is affixed to a fastener (either a hook fastener section 40A or a loop fastener section 40B) on the outer surface of the heel strap 27. For example, the centrally-located fastener on the heel pad 10 is a hook fastener section 40A that can be affixed to a loop fastener section 40B on the outer surface of the heel strap 27. This allows for the heel pad 10 to be mounted to the heel strap 27.

Figure 12A:
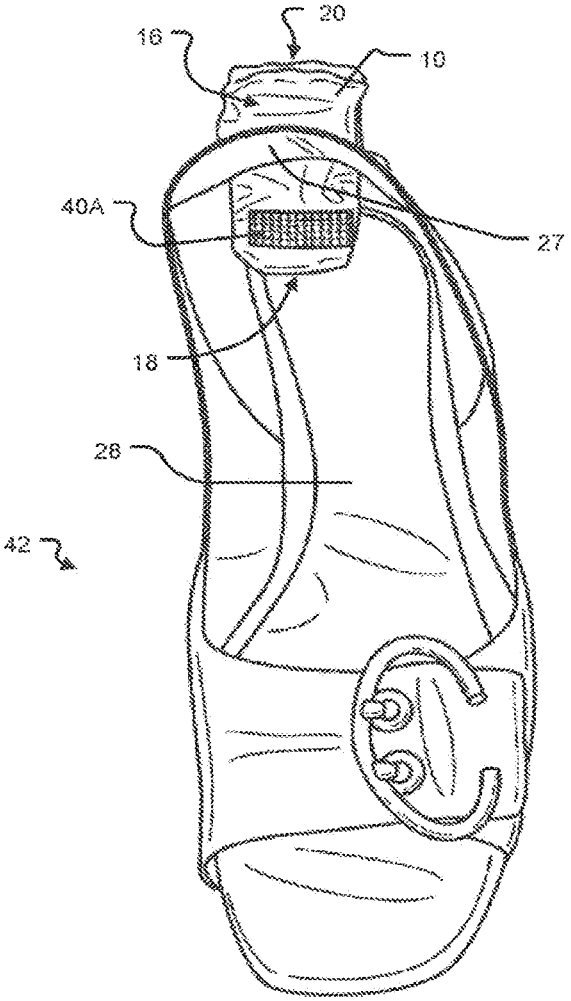
FIG. 12A is a front perspective view of the unwrapped heel pad of FIG. 11 having a hook fastener section.
Figure 12B:
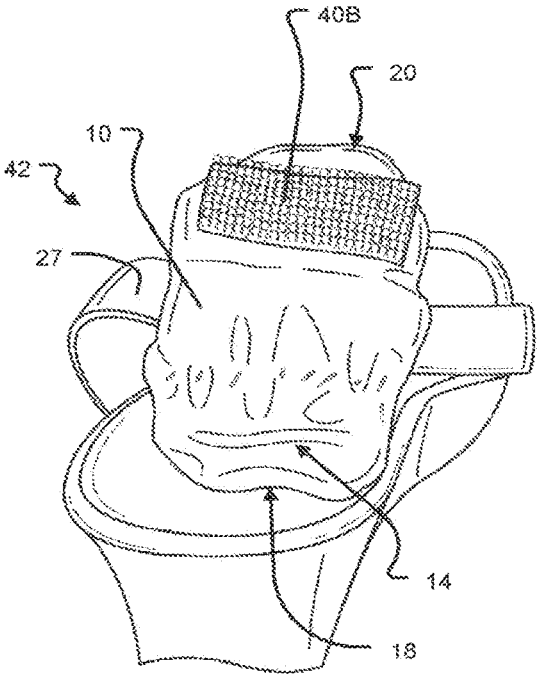
FIG. 12B is a back perspective view of the unwrapped heel pad of FIG. 11 having a loop fastener section.

As illustrated in FIGS. 12A-12B, the heel pad 10 of FIG. 11 further includes two fastener sections 40A, 40B for attaching to itself. The heel pad 10 includes a hook fastener section 40A on the shoe side 16 of the pliable body 12 near the first end 18 (as illustrated in FIG. 12A). The heel pad 10 includes a loop fastener section 40B on the foot side 14 of the pliable body 12 near the second end 20 (as illustrated in FIG. 12B). While the heel pad 10 is affixed to the heel strap 27, the hook fastener section 40A (i.e., first end 18 of the shoe side 16) is affixed to the loop fastener section 40B (i.e., second end 20 of the foot side 14) such that the heel pad 10 is wrapped around the heel strap 27 as illustrated in FIG. 11.

As shown in FIGS. 1-12B, the heel pad 10 provides a distinct ornamental design by itself. Also, the figures illustrate the heel pad 10 as providing a distinct ornamental design when mounted within the shoe 34, 35, 42 or inserted with the shoe 34, 35, 42.

Figure 13:
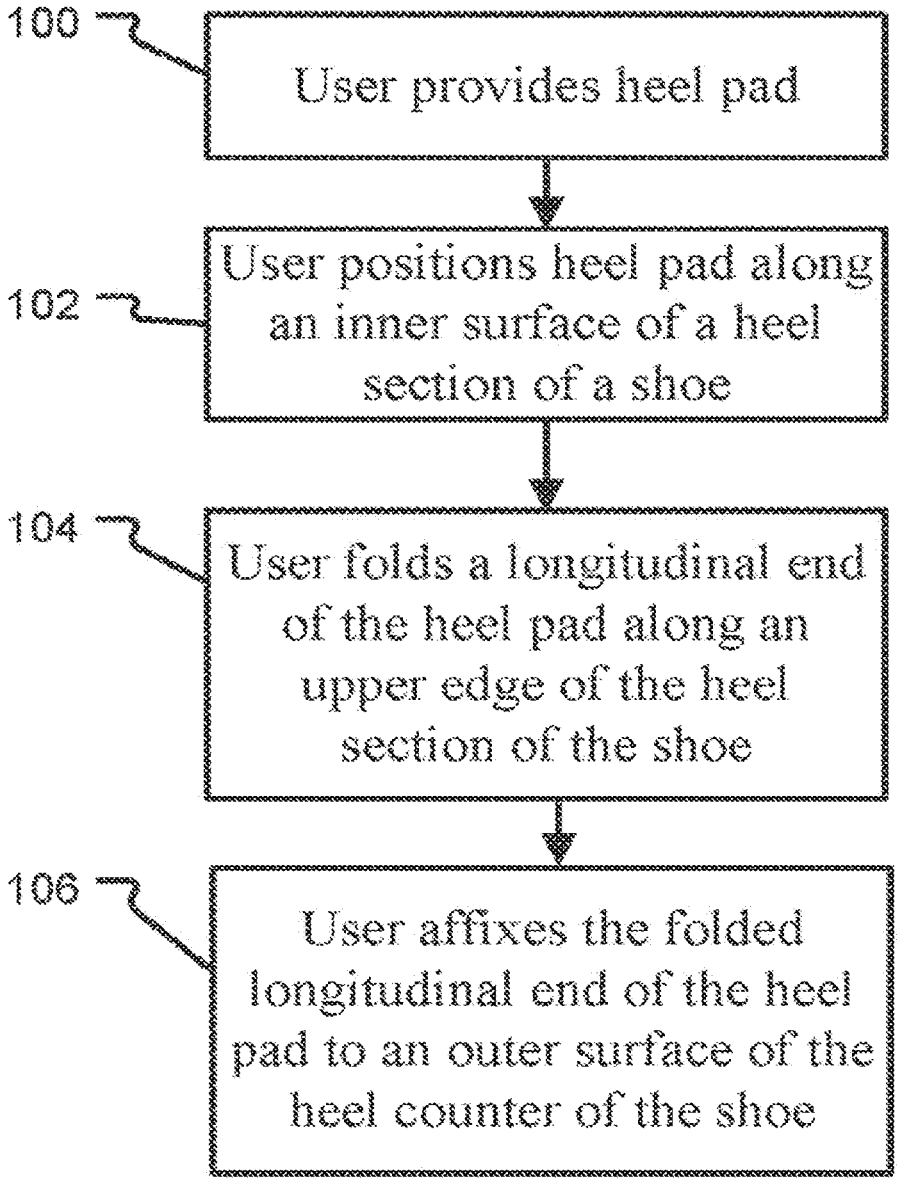
FIG. 13 is a flow chart illustrating a process of using the heel pad according to an embodiment of the present invention.
Figure 14:
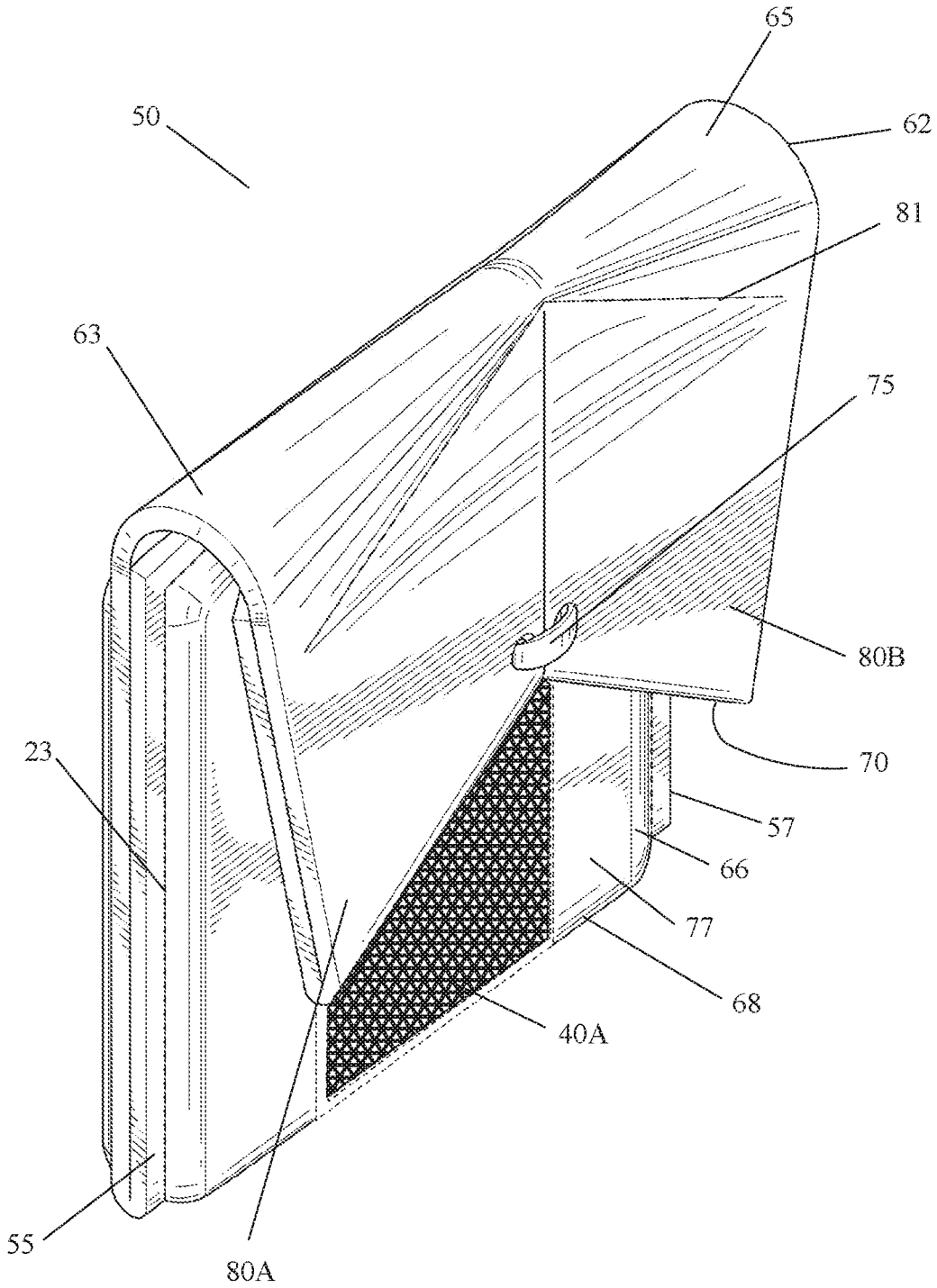
FIG. 14 is a perspective view of a heel pad of an alternate embodiment.

FIG. 13 illustrates a preferred operation or use of the heel pad 10. In step 100, a user provides the heel pad 10 as described above. The user positions the heel pad 10 along an inner surface 26A, 126B of a heel section 46 (e.g., heel counter 26, 126 or heel strap 27) of the shoe 34, 35, 42 (step 102). In one example, the heel pad 10 includes a fastener (hook and loop, adhesive strips, etc.) for releasably attaching the heel pad 10 to the inner surface of the heel section 46. In step 104, the user folds a longitudinal end (i.e., second end 20) of the heel pad 10 along an upper edge of the heel section 46 (e.g., heel counter 26, 126 or heel strap 27) of the shoe 34, 35, 42. The user affixes the folded longitudinal end (i.e., second end 20) of the heel pad 10 to an outer surface of the heel section 46 (e.g., heel counter 26, 126 or heel strap 27) of the shoe 34, 35, 42 (step 106).

FIGS. 14-17 show a heel pad of an alternate embodiment.

Figure 15A:
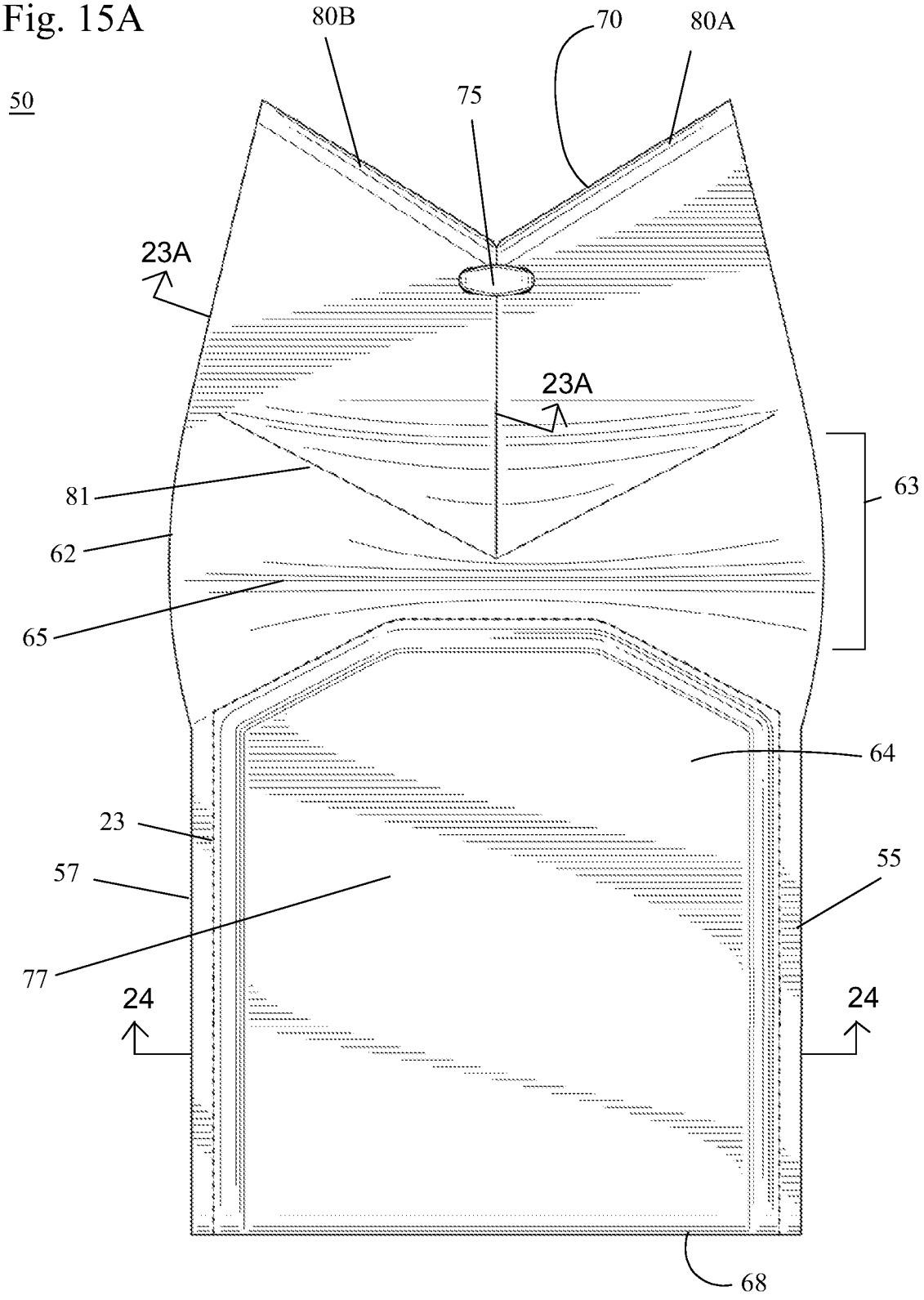
FIG. 15A is a foot side or back view of the heel pad of the alternate embodiment in an open position.
Figure 15B:
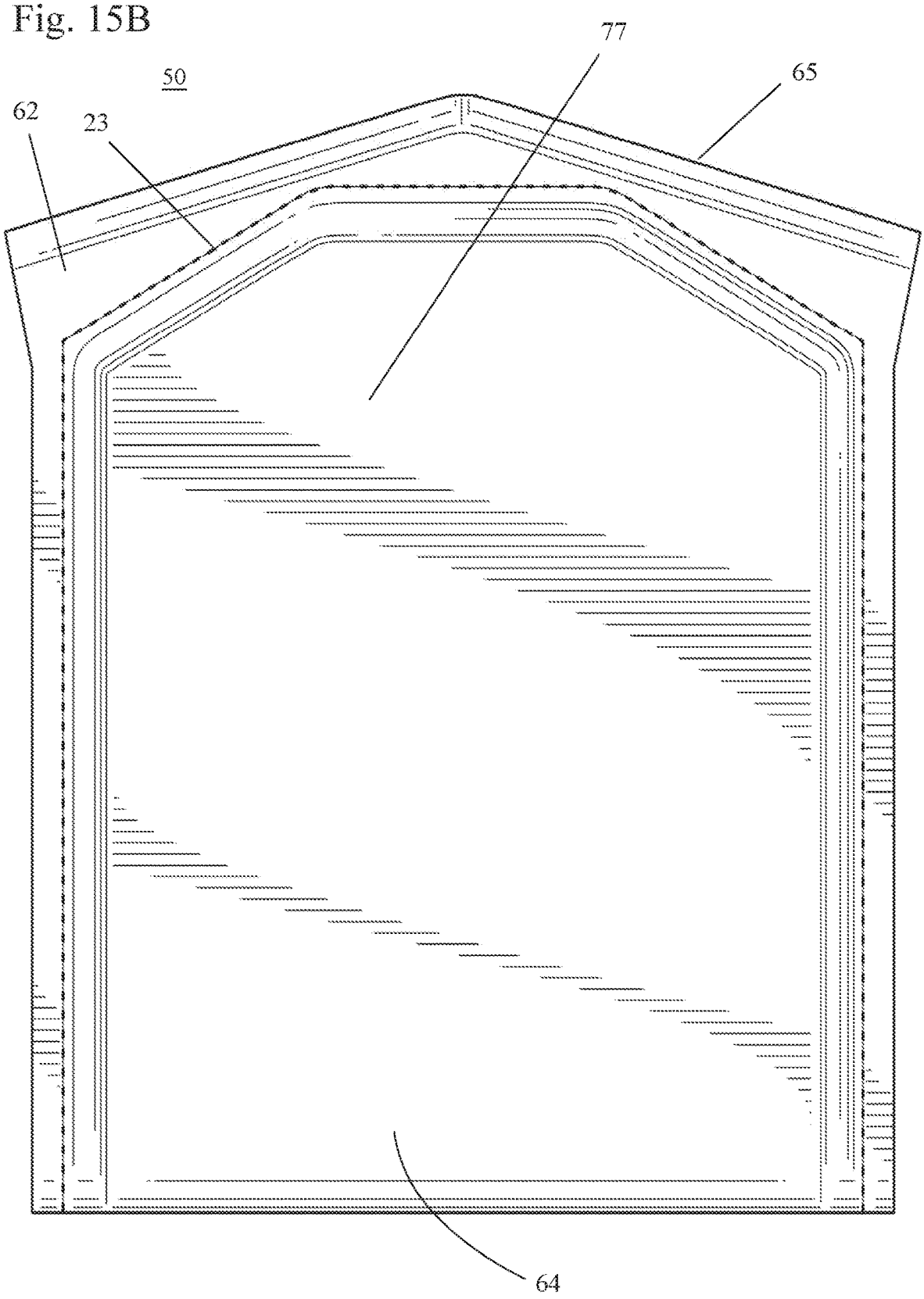
FIG. 15B is a foot side or back view of the heel pad of the alternate embodiment in a closed position.
Figure 16A:
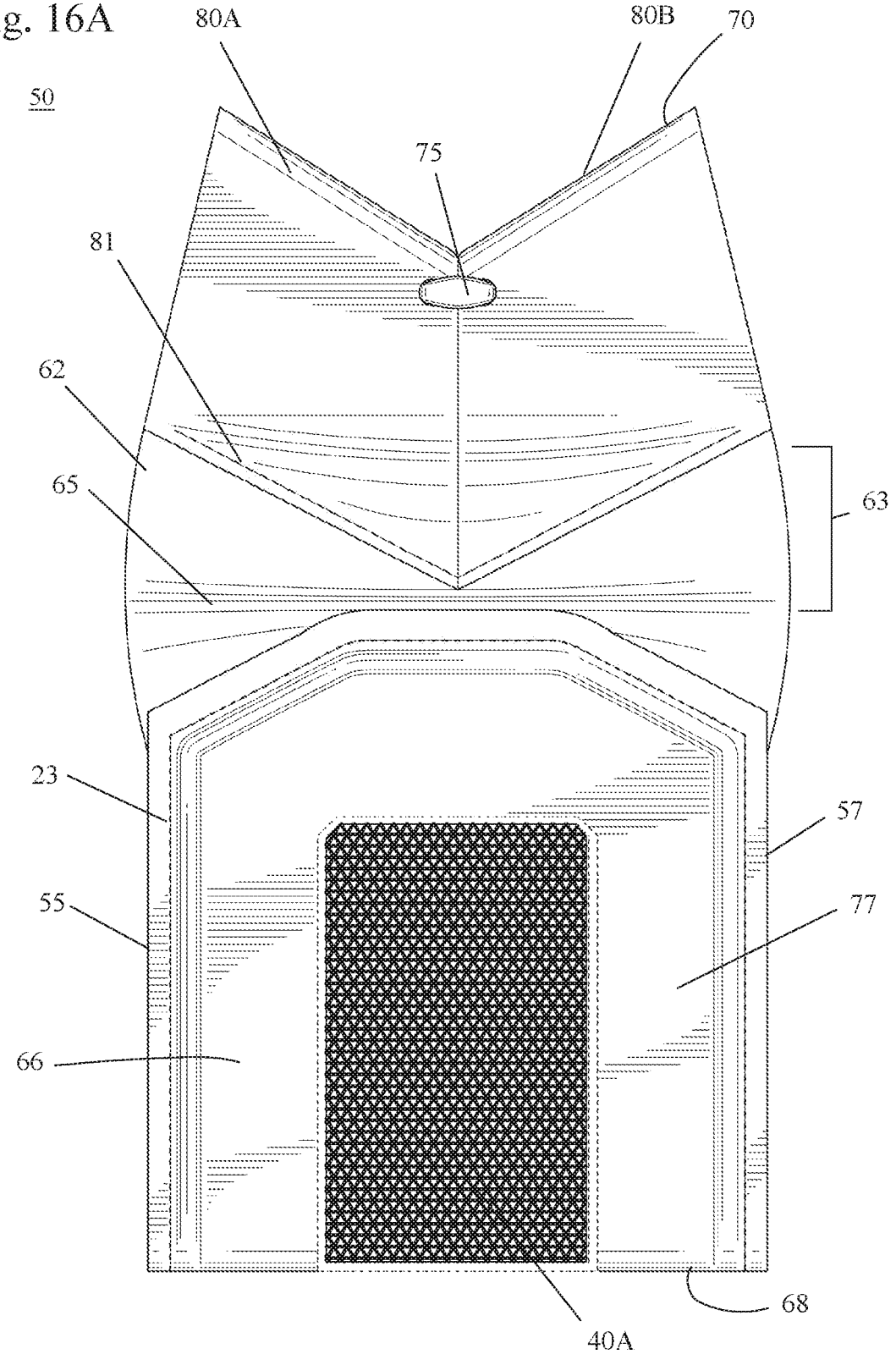
FIG. 16A is a front view or shoe side view of the heel pad of the alternate embodiment in an open position.
Figure 16B:
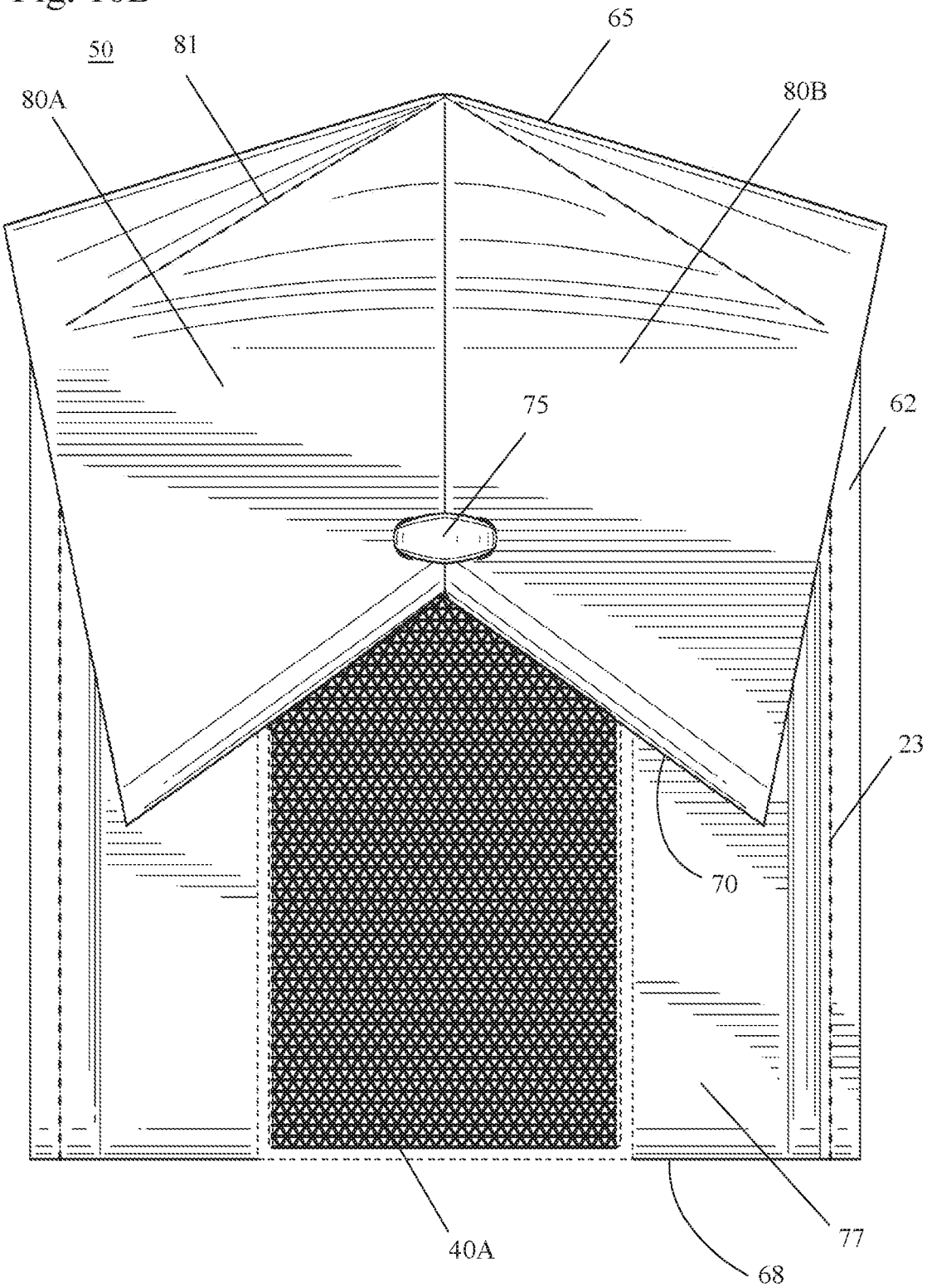
FIG. 16B is a front view or shoe side view of the heel pad of the alternate embodiment in a closed position.
Figure 17:
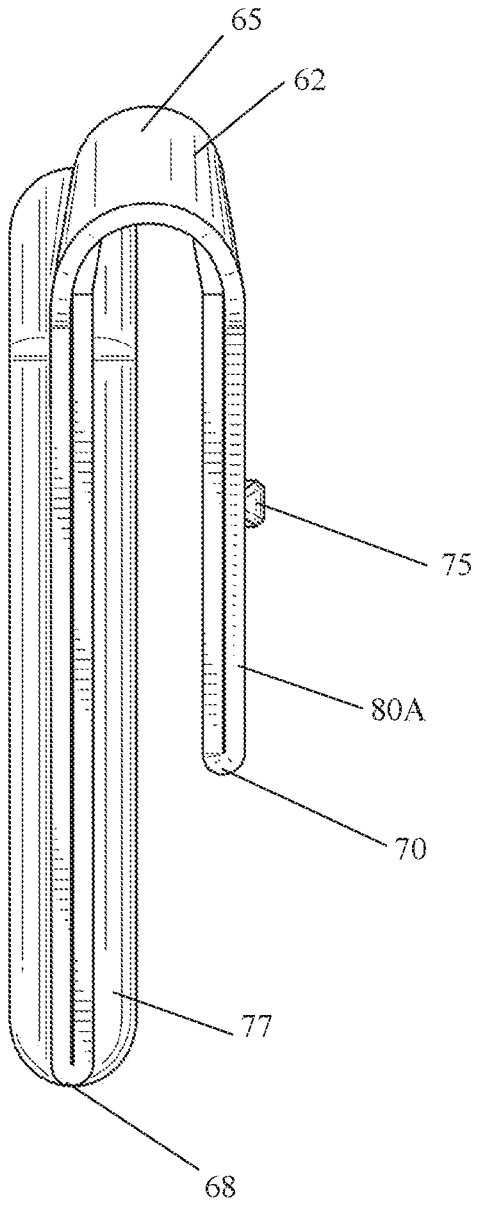
FIG. 17 is a side view of the heel pad of the alternate embodiment.

The heel pad 50 includes a pliable body 62 forming a shape of the heel pad 50 with a foot side 64 for receiving the heel of a wearer's foot and a shoe side 66 for placement against an inside surface of a shoe. The pliable body 62 has a rectangular shape from the first end 68 which tapers to and extends from a foldable portion 63 to two separated flaps, a first flap 80A and a second flap 80B at the second end 70. The foldable portion 63 is present between stitching 23 and the malleable member stitching 81. The two separated flaps 80A, 80B are stitched 75 or secured together at the second end 70 such that when the flaps 80A, 80B are placed on and pliably shaped to a rounded heel section of the shoe, a gap 78 is present between the two flaps 80A, 80B. The stitch 75 may be replaced with a button, clasp or other means to hold the flaps 80A, 80B together. The pliable body 62 body is foldable along a fold 65 within the foldable portion 63 of the pliable body 62 along the length between the two flaps 80A, 80B and a pad portion 77 of the pliable body 62, allowing the heel pad 50 to have an open position as shown in FIGS. 15A, 16A and a closed position FIGS. 14, 15B, 16B, 17.

The heel pad 50 can be sized to fit a variety of different shoes as appreciated by one of skill in the art. The heel pad can be of various lengths to accommodate different lengths and widths of the heel counter of the heel sections of different shoes, regardless of the actual heel height of the shoe.

For example, in one embodiment the heel pad 50 is sized to fit a shoe 35 with heel counter 26 having a standard length L1, as shown in FIGS. 14-18D and in another embodiment the heel pad 50 is sized to fit an alternate shoe 34 with heel counter 126 having a nonstandard heel counter length L2, which is greater than length L1, as shown in FIGS. 19A-26.

The heel pad 50 has a length stretching from a first end 68 to a second end 70 that can be increased or decreased to fit a variety of different shoes as appreciated by one of skill in the art. Relative to an average heel pad length, the heel pad length is designed to be shorter for the shoes with a heel counter 26 of a standard heel counter length L1, whereas the heel pad length is designed to be longer for the shoe with a nonstandard heel counter 126 having a length L2. In examples, the heel pad 50 has a total length (from the first end 68 to the second end 70 and measured at max length of shape) between about 8 cm and about 9 cm. The heel pad 50 has a total width (from a first side 55 to a second side 57 and measured at max width of shape of the heel pad) between about 5 cm and about 6 cm that extends in parallel with a 24-24 axis. The heel pad 50 can be designed with other measurements as appreciated by one of skill in the art in order to accommodate other shoe types and their associated heel counter.

The pliable body 62 can be constructed from a variety of materials. For example, the pliable body 62 can be constructed from one or more layers of cotton, soft leather, suede, micro suede, neoprene, polyester, or other materials as appreciated by one of skill in the art. In one embodiment, materials may be selected such that the color of the pliable body 62 matches and blends in with the color of the shoe. In still another embodiment, materials may be selected to produce a pattern and/or an image on the pliable body 62. Materials may be selected to produce other colors and/or designs for the pliable body 62 as appreciated by one of skill in the art.

Present within the two flaps 80A, 80B are at least one malleable member 24. The malleable members 24 extend from the second end 70 towards the pad portion 77 a length. The length is preferably less than the length between the fold 65 and the second end 70 of the pliable body 62. The malleable members are held in place within the flaps 80A, 80B by malleable member stitching 81. The malleable members are preferably the same malleable members 24 as those shown and discussed relative to FIGS. 4A-4C and may be covered by a fabric covering 44 as shown in FIGS. 5A-5B.

Figure 23A:
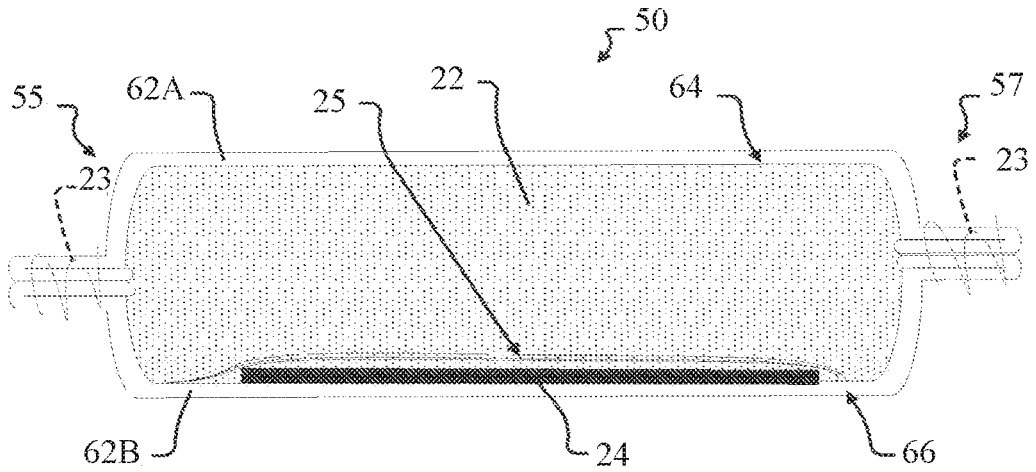
FIG. 23A is a cross-sectional view along a 23A-23A axis of the heel pad of FIG. 15A according to one embodiment of the present invention.

FIG. 23A illustrates an embodiment where the heel pad 50 includes one malleable member 24 extending from the second end 70 of a flap 80A a length along the pliable body 62. The length of the malleable member 24 is less than the length between the second end 70 and the fold 65 of the foldable portion 63. The flaps 80A, 80B are preferably constructed of a fabric layer 62A which is folded over itself and stitched. Malleable member stitching 81 is used to maintain the malleable member within the flap 80A. Stitching 25 is used to fasten the malleable member 24 proximate to the pliable body 62. Other methods of fastening the malleable member 24 may also be used or in conjunction with the stitching 25. It should be noted that while one flap 80A is shown, the malleable member 24 would be present in flap 80B as well.

Figure 24:
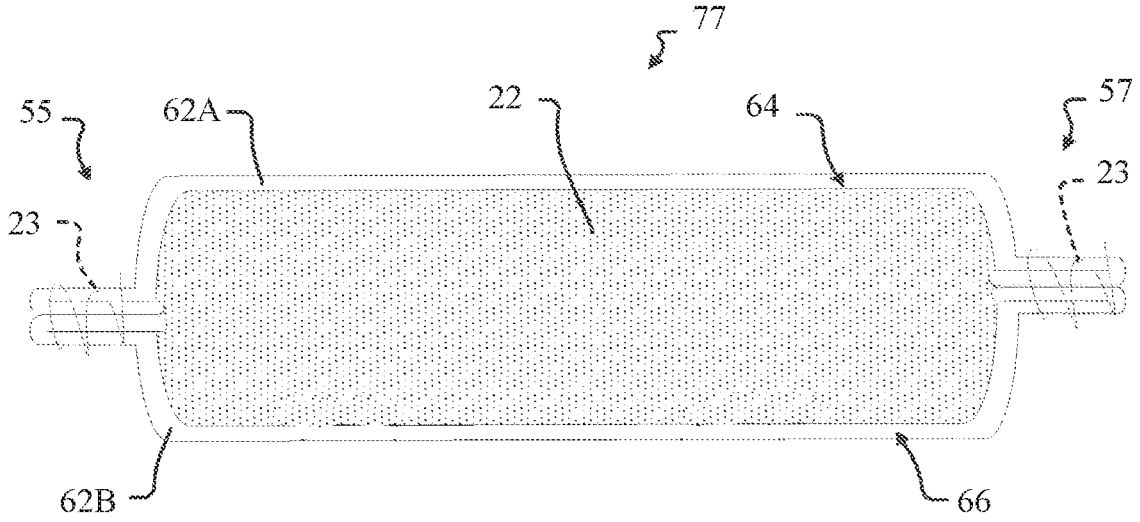
FIG. 24 is a cross-sectional view along line 24-24 axis of the heel pad of FIGS. 15A and 19A according to one embodiment of the present invention.

As illustrated in the cross-section of FIG. 24 the pad portion 77 of the pliable body 62 is constructed from two fabric layers 62A, 62B. Each fabric layer 62A/62B is folded on two opposing sides (first side 55 and second side 57). As shown, the upper fabric layer 62A is folded over itself at the first side 55 and folded over itself at the second side 57. Similarly, the lower fabric layer 62B is folded over itself at the first side 55 and folded over itself at the second side 57. The fabric layers 62A, 62B are stitched together at these folded sides using body stitching 23 (e.g., fabric stitching). In particular, the folded sides of the upper fabric layer 62A are stitched directly to the folded sides of the lower fabric layer 62B forming a seam along the body stitching 23. The upper fabric layer 62A is the foot side 64 of the pliable body 62 and the lower fabric layer 62B is the shoe side 66 of the pliable body 62. The two fabric layers may be of a single fabric sheet.

The heel pad portion 77 includes a filler element 22 contained within the pliable body 62 (i.e., between the upper fabric layer 62A and the lower fabric layer 62B). The filler element 22 typically includes a material that generally has soft, flexible, and moldable properties. For example, the filler element 22 can include a polyester pile, beads, foam, multiple sheets of polyester, microfiber, gel, feathers, silk, linen, rubber, synthetic plastic, rigid paper, or other materials as appreciated by one of skill in the art.

FIGS. 18A, 18B, 18C and 18D illustrate use of the heel pad 50 in a shoe 35 in different views. In one example, a portion of the heel pad 50 that folds along the upper edge 26*b* of the heel counter 26 has a length to the end 70 of the flap 80A, 80B between approximately 3.5 cm to 4.5 cm.

The shoe 35 includes an insole 28 coupled between a heel section 46 and a toe box 38. The heel section 46 includes a heel 36 attached below the heel counter 26. The heel counter 26 has a length L1. The length L1 is measured from the insole 28 of the shoe to the upper edge 26*b* of the heel counter 26.

The heel pad 50 is positioned along an inner surface 26*a* of the heel counter 26. In addition to the shoe 35, the heel pad 50 may be used with casual shoes, dress shoes, sneakers, boots, sports shoes, ice skates, cross trainer shoes, cleats, ski boots, sandals, flats, or other shoes as appreciated by one of skill in the art.

The malleable member 24 within the flaps 80A, 80B of the heel pad 50 allow the flaps 80A, 80B to be bent or folded or shaped to conform over the rounded heel section 46 of the outer surface 26*c* of the heel counter 26.

Figure 18A:
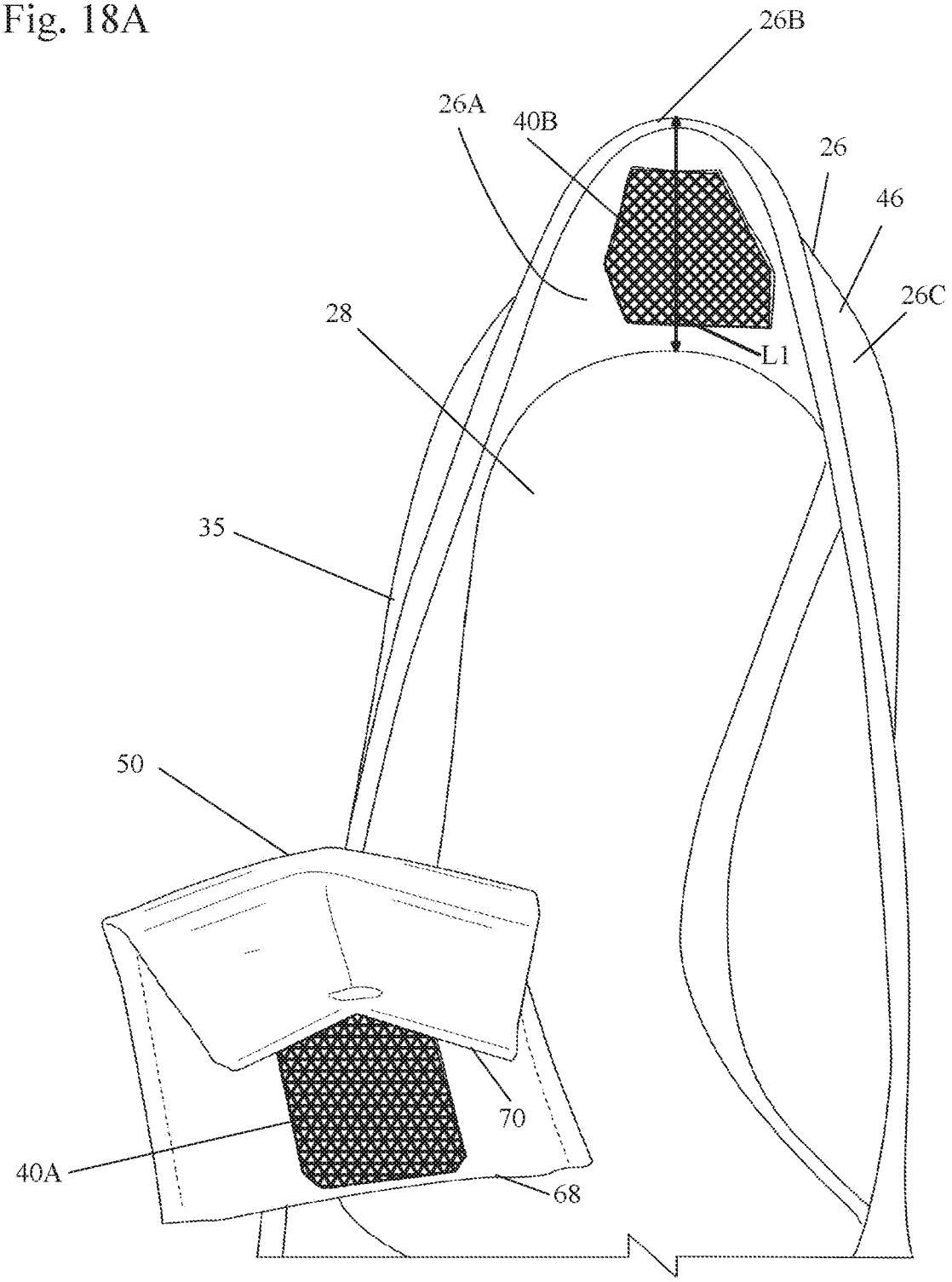
FIG. 18A is a partial perspective view of the heel pad of the alternate embodiment having a fastener for attaching the heel pad within a shoe according to an embodiment of the present invention.
Figure 18B:
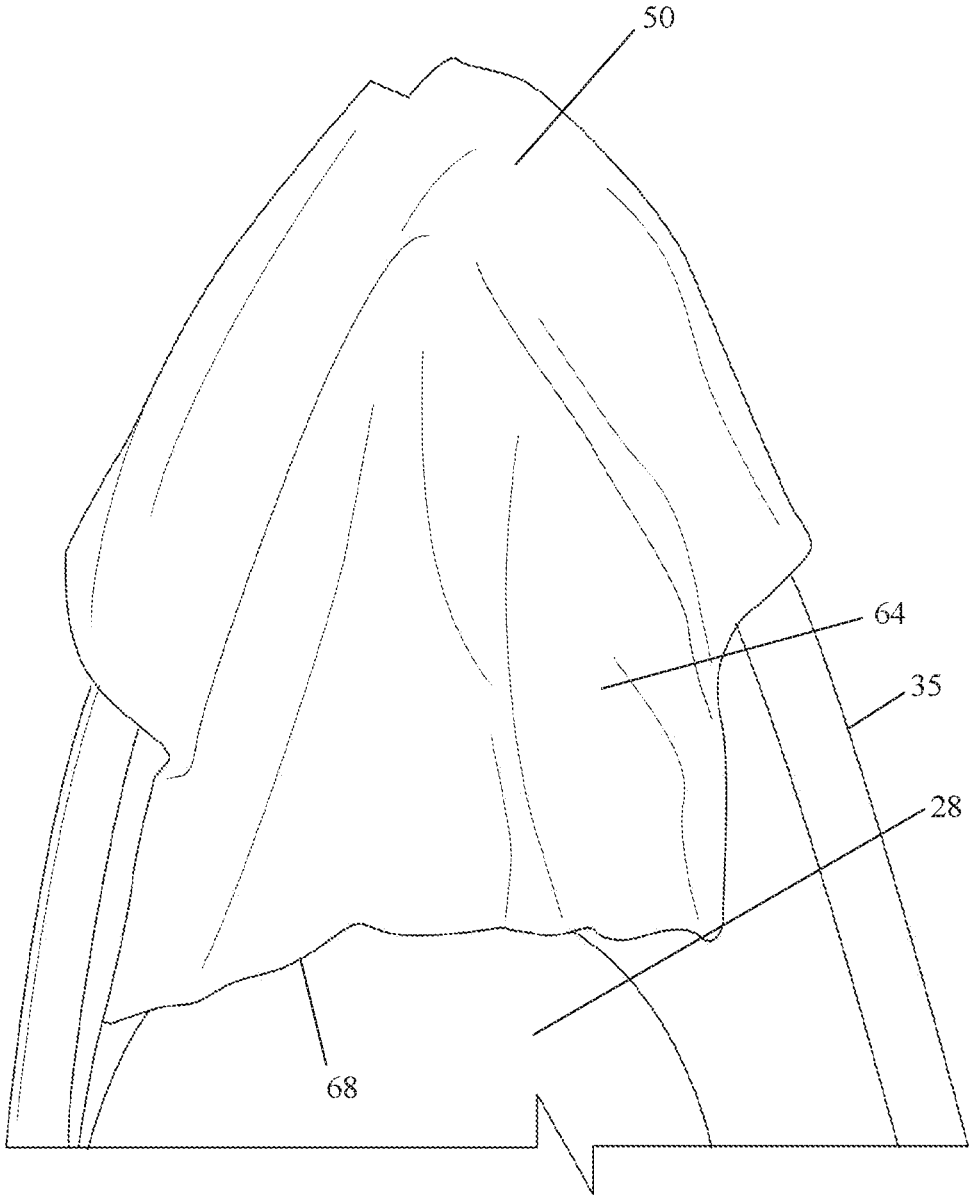
FIG. 18B is a front perspective view of the heel pad of the alternate embodiment positioned in the shoe of FIG. 18A.
Figure 18C:
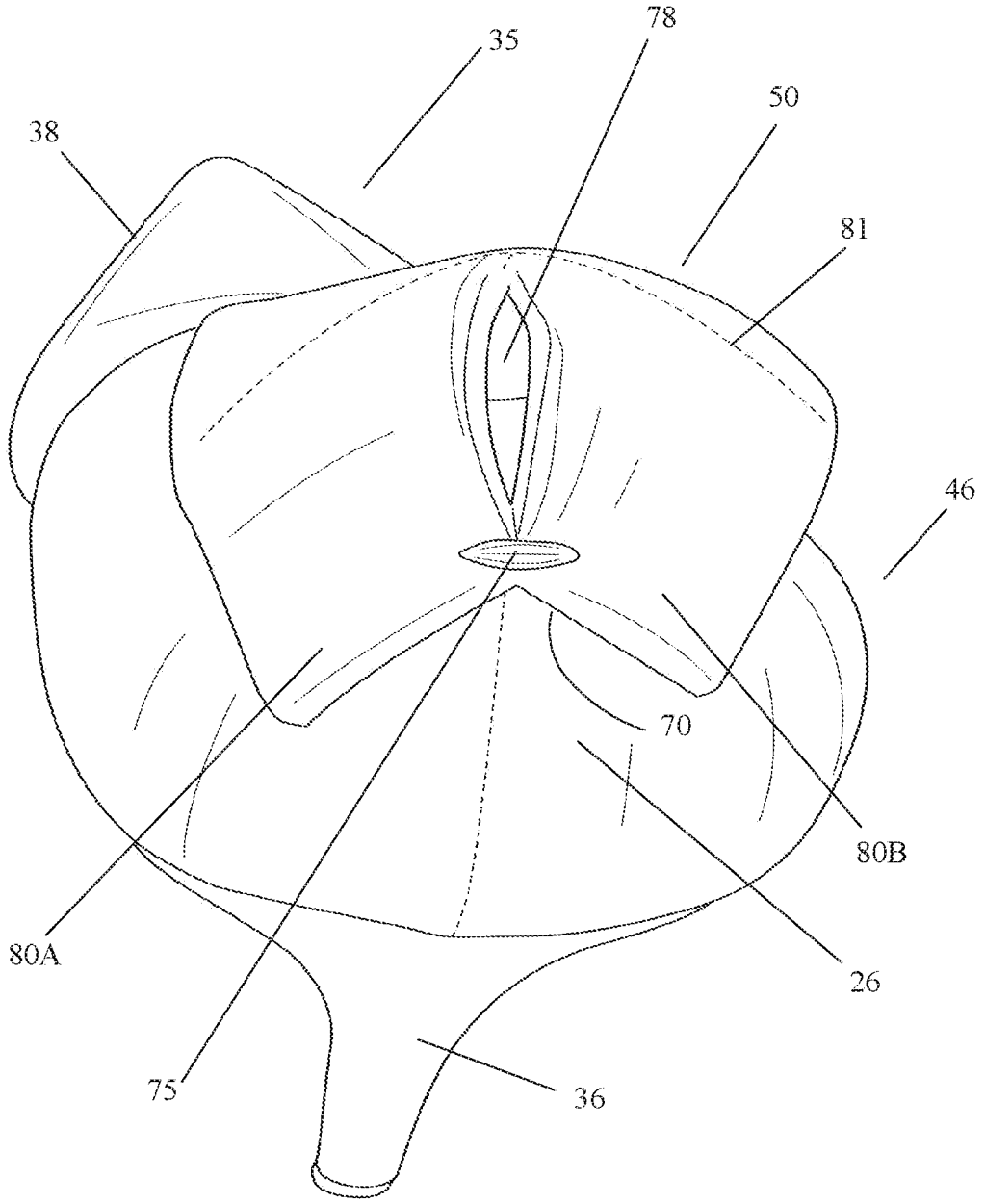
FIG. 18C is a back perspective view of the heel pad of the alternate embodiment positioned in the shoe of FIG. 18A.
Figure 18D:
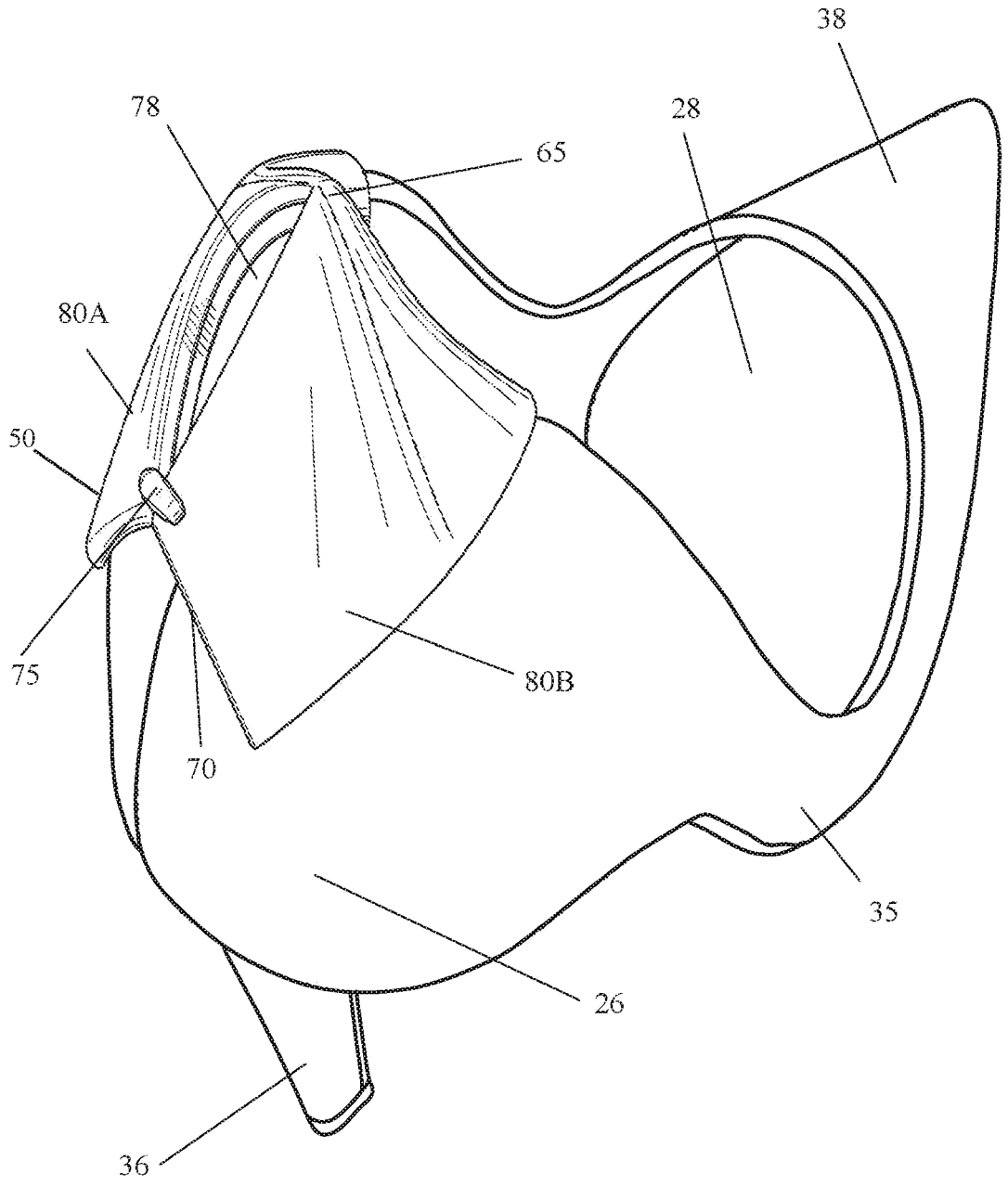
FIG. 18D is a partial side perspective view of the heel pad of the alternate embodiment positioned in the shoe of FIG. 18A.

As illustrated in FIGS. 18B-18D, the flaps 80A, 80B of the heel pad 50 are folded over the heel counter 26, such that the fold 65 sits on the upper edge 26*b* of the heel counter 26. In particular, the first end 68 of the heel pad 50 is positioned along the inner surface 26*a* of the heel counter 26 and the second end 70 (i.e., longitudinal end) of the heel pad 50 is folded along fold 65 and rests along an upper edge 26*b* of the heel counter 26 such that the flaps 80A, 80B mold to the outer surface 26*c* of the heel counter 26. In some embodiments, the flaps 80A, 80B separate slightly, based on the constraints of the stitch 75, so that a gap 78 is present between the flaps 80A, 80B. It should be noted that the stitch 75 and the gap 78 present between the flaps 80A, 80B allows the flaps to be molded and secure to the rounded heel counter 26.

As illustrated in FIG. 18A, the heel pad can include a fastener for attaching the heel pad 50 within a shoe. The fastener provides additional support in maintaining the heel pad 50 within the shoe (i.e., assist in keeping the heel pad 50 in place). For example, the shoe side 66 of the heel pad 50 is releasably attached to the inner surface 26*a* of the heel counter 26 of the shoe 35 using the fastener such that the heel pad 50 is attached and detached from the heel counter 26 of the shoe 35.

The heel pad 50 can utilize a hook and loop type of fastener for attaching the heel pad 50 within a shoe 35. In particular, the shoe side 66 of the heel pad 50 includes a hook fastener section 40A which releasably attaches to or detaches from a loop fastener section 40B on the inner surface 26*a* of the heel counter 26 of the shoe 35.

The heel pad 50 can be adhered into the shoe 35 using a different fastener such as an adhesive strip (e.g., peel and stick type of adhesive). In one example, the adhesive strip is placed on the shoe side 66 of the heel pad 50 and the heel pad 50 is attached to the heel counter 26 using the adhesive strip. In another example, one adhesive strip is placed on the shoe side 66 of the heel pad 50 and a complementary adhesive strip is placed on the inner surface 26*a* of the heel counter 26. The heel pad 50 is attached to the heel counter 26 using these complementary adhesive strips.

The heel pad 50 can use other fastening means such as sewing, tacking, riveting, button fasteners, magnetic fasteners, or other adhesive mechanisms for providing additional support in attaching the heel pad 50 into the heel counter 26 as appreciated by one of skill in the art.

FIGS. 19A-26 show another alternate heel pad. The heel pad 150 of this embodiment differs from heel pad 50, as the length between the first end and the second end is increased and is sized to fit in an alternate shoe with a heel section 46 having a heel counter 126 of a nonstandard length L2. The length L2 of the alternate shoe 34 is preferably greater than the length L1 of shoe 35. Furthermore, the alternate heel pad 150 differs from heel pad 50, in that malleable members 24 preferably extend from within the flaps 80A, 80B until the pad portion 77, e.g. the malleable members extend through the foldable portion 63. By having the malleable members extend through the foldable portion 63, the heel pad 150 is alterable to fit various lengths L2 of the nonstandard heel counter 126.

The heel pad 150 has a length stretching from a first end 68 to a second end 70 that can be increased or decreased to fit a variety of different shoes as appreciated by one of skill in the art. In this example, the heel pad 150 has a total length (from the first end 68 to the second end 70 and measured at max length of shape) between about 12 cm and about 13 cm. The heel pad 150 has a total width (from a first side 55 to a second side 57 and measured at max width of shape of the heel pad) between about 3 cm and about 4 cm that extends in parallel with a 24-24 axis. The heel pad 150 can be designed with other measurements as appreciated by one of skill in the art in order to accommodate other shoe types.

Figure 19A:
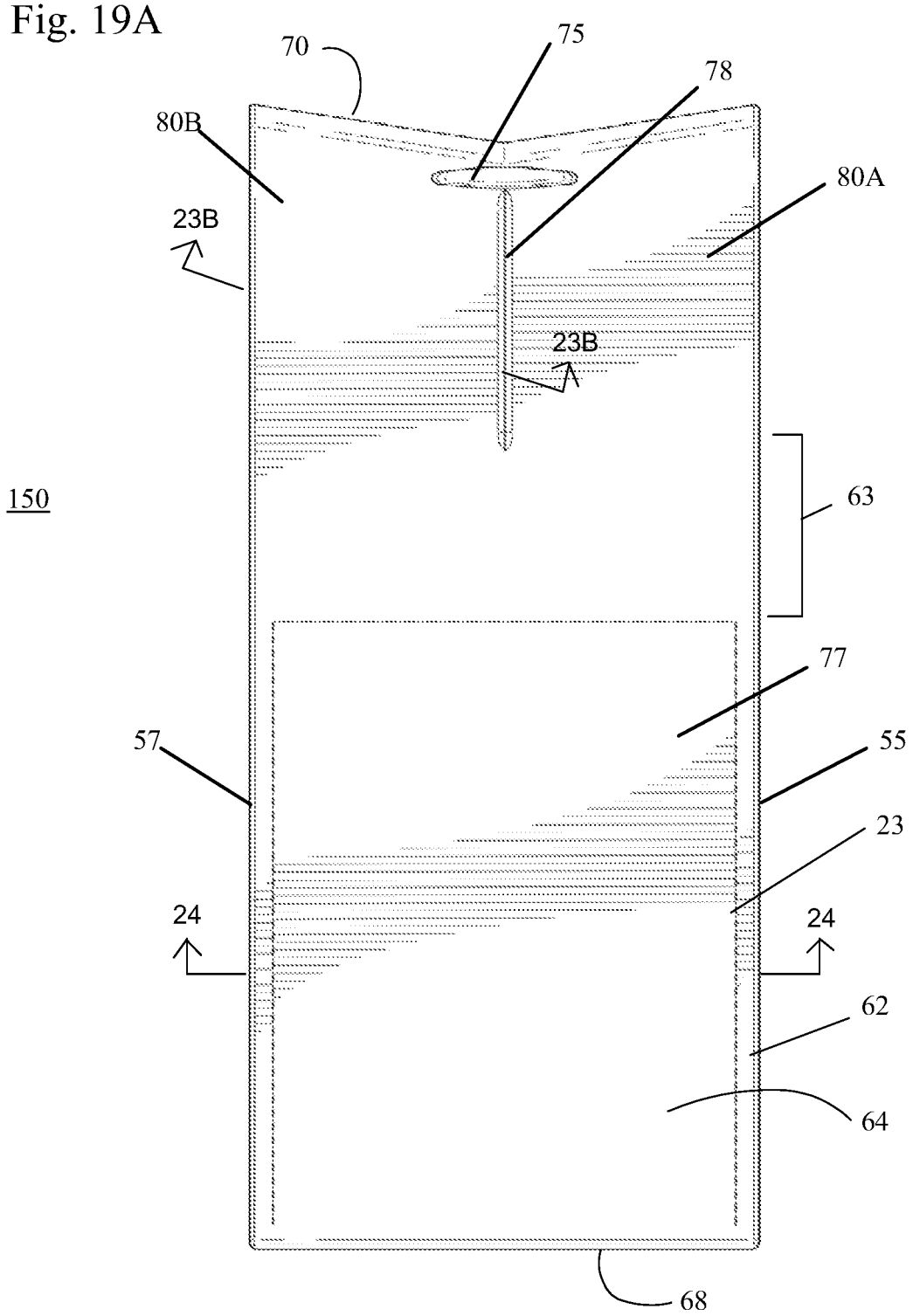
FIG. 19A is a foot side or back view of the heel pad of another alternate embodiment in an open position.
Figure 19B:
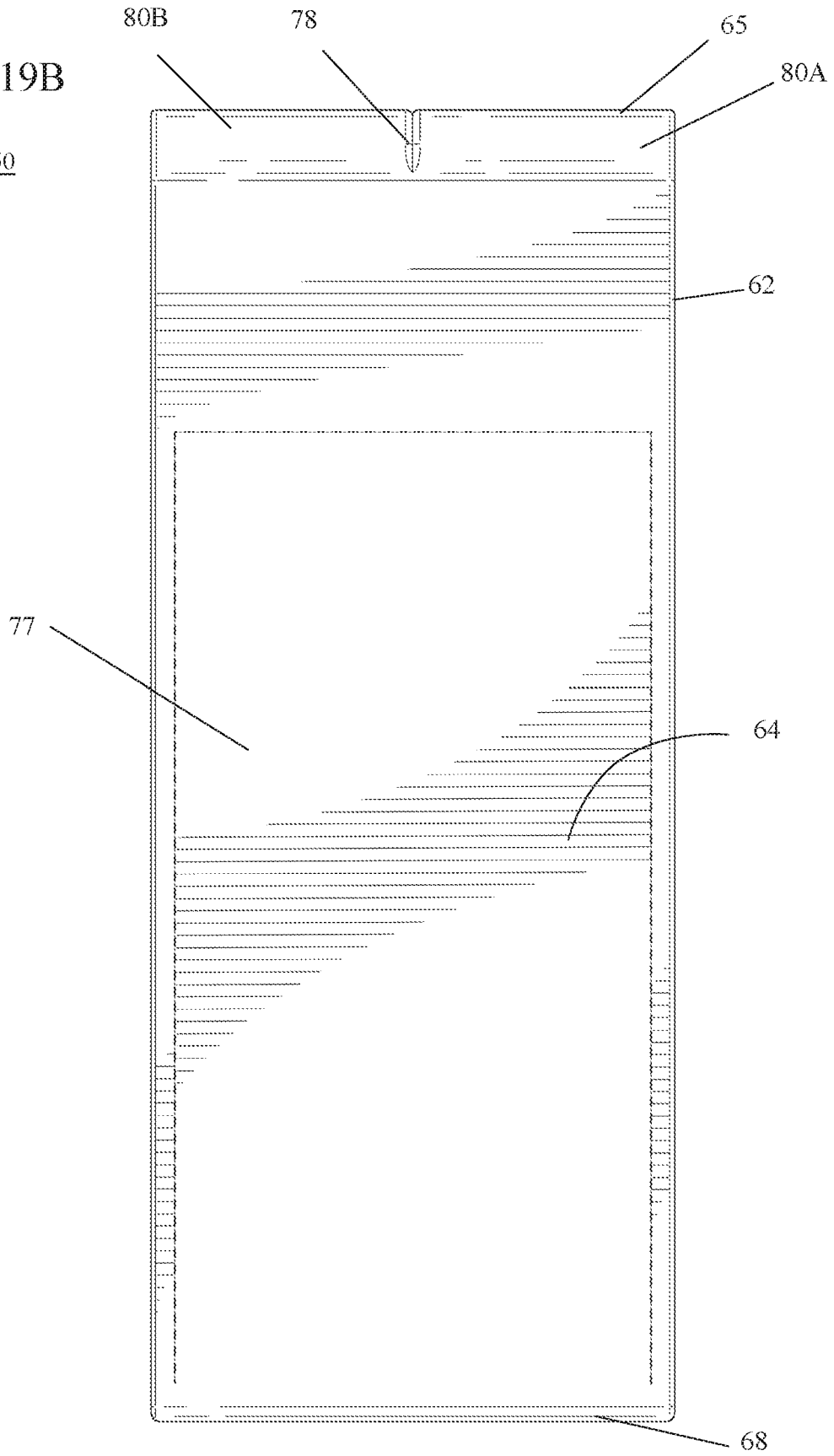
FIG. 19B is a foot side or back view of the heel pad of another alternate embodiment in a closed position.
Figure 20A:
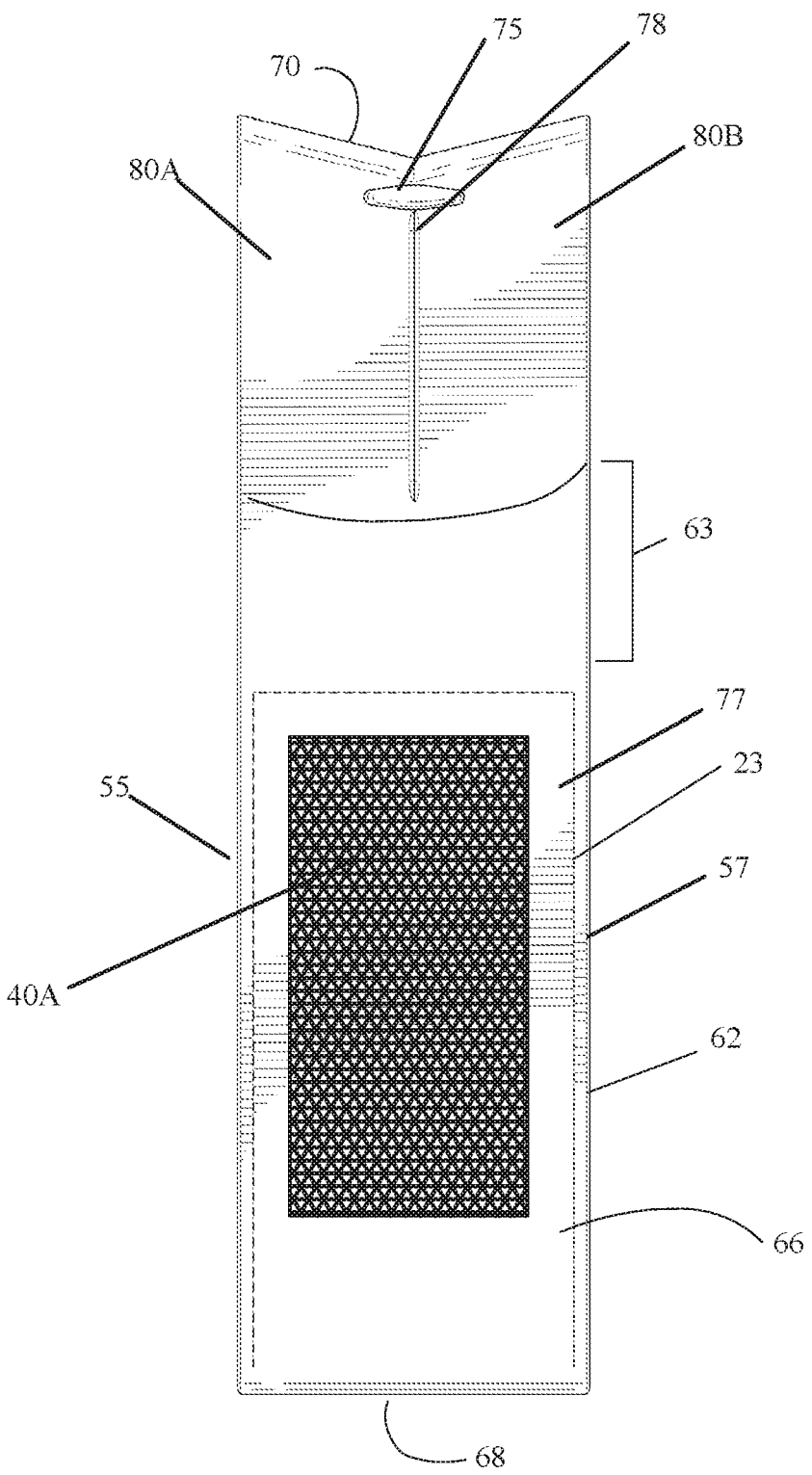
FIG. 20A is a front view or shoe side view of the heel pad of another alternate embodiment in an open position.
Figure 20B:
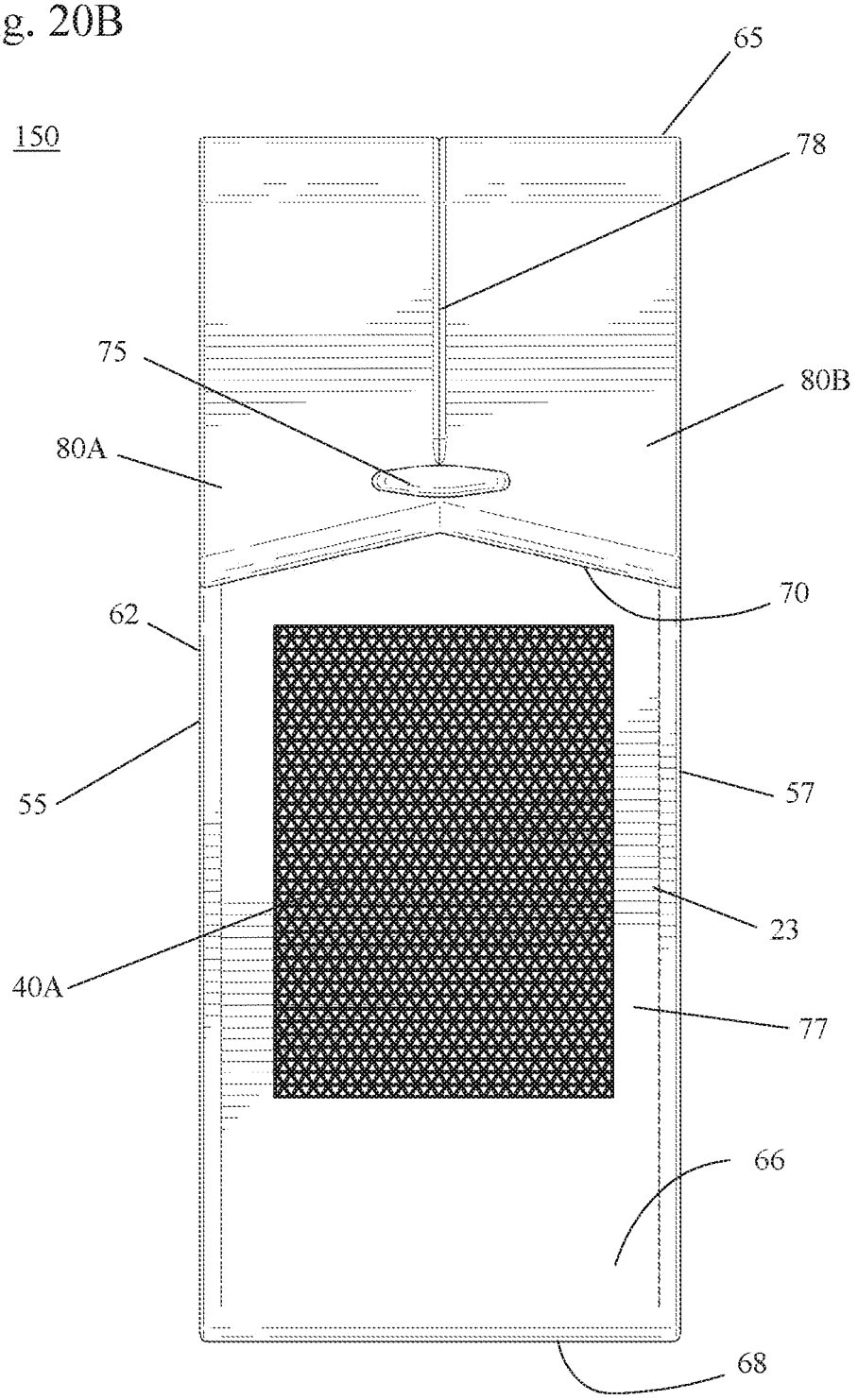
FIG. 20B is a front view or shoe side view of the heel pad of another alternate embodiment in a closed position.
Figure 21:
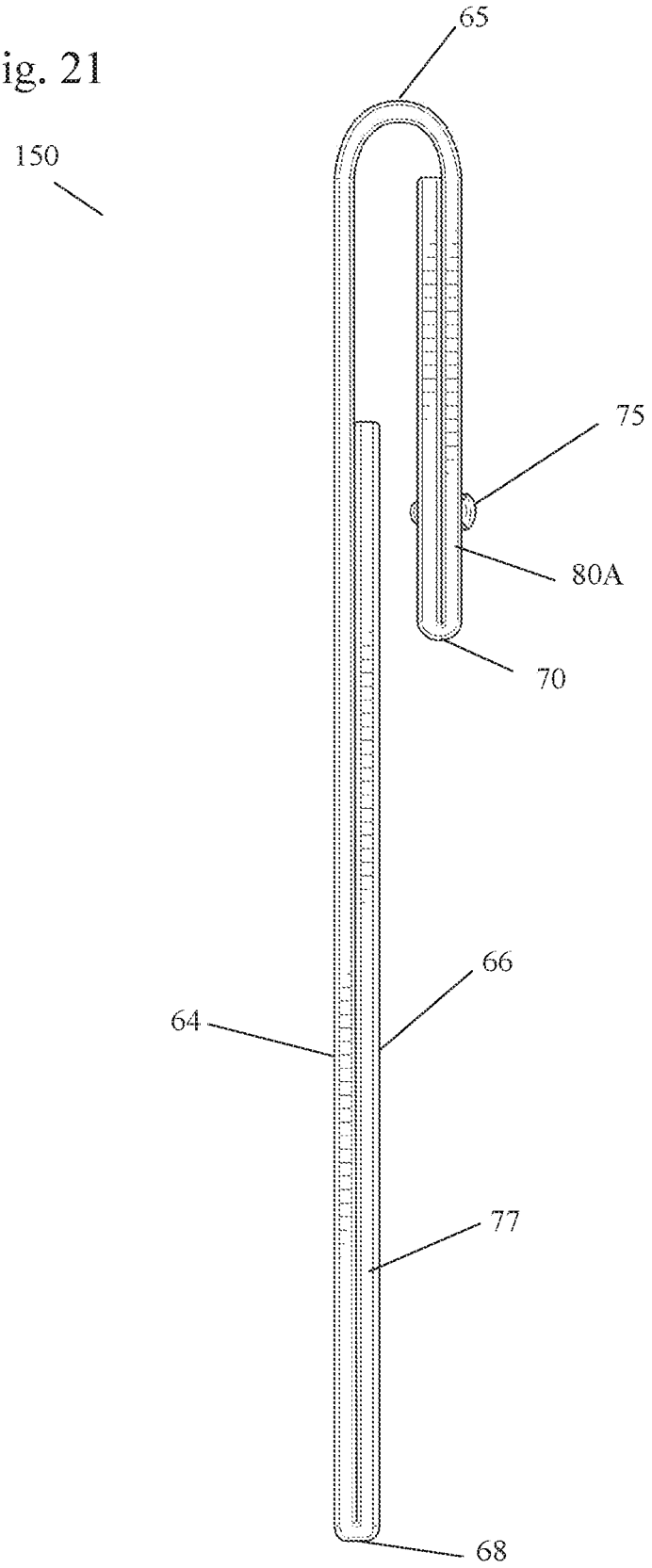
FIG. 21 is a side view of the heel pad of another alternate embodiment.

The heel pad 150 includes a foot side 64 for receiving the heel of a wearer's foot. The heel pad 150 includes a shoe side 66 for placement against an inside surface of a shoe. The heel pad 150 includes a pliable body 62 forming a shape of the heel pad 150. The pliable body 62 has a rectangular shape from the first end 68 which tapers to and extends from a foldable portion 63 to two separated flaps, a first flap 80A and a second flap 80B at the second end 70. The two separated flaps 80A, 80B are stitched 75 or secured together at the second end 70 such that when the flaps 80A, 80B are placed on and pliably shaped to a rounded heel section of the shoe, a gap 78 is present between the two flaps 80A, 80B. The pliable body 62 body is foldable along a fold 65 within the foldable portion 63 of the pliable body 62 along the length between the two flaps 80A, 80B and a pad portion 77 of the pliable body 62, allowing the heel pad 150 to have an open position as shown in FIGS. 19A, 20A and a closed position FIGS. 19B, 20B, 21.

The pliable body 62 can be constructed from a variety of materials. For example, the pliable body 62 can be constructed from one or more layers of cotton, soft leather, suede, micro suede, neoprene, polyester, or other materials as appreciated by one of skill in the art. In one embodiment, materials may be selected such that the color of the pliable body 62 matches and blends in with the color of the shoe. In still another embodiment, materials may be selected to produce a pattern and/or an image on the pliable body 62. Materials may be selected to produce other colors and/or designs for the pliable body 62 as appreciated by one of skill in the art.

Present within the two flaps 80A, 80B are at least one malleable member 24. The malleable members 24 extend from the second end 70 towards the pad portion 77 a length. The length is preferably less than or equal to the length between the ends 70 of the flaps 80A, 80B and the body stitching 23 of the pad portion 77. In this embodiment, the malleable members 24 are preferably held in place along the pliable body 62 and within the flaps 80A, 80B by the member stitching 23. Other methods may be used to secure the malleable member 24 in place within the pliable body 62. The malleable members are preferably the same malleable members 24 as those shown and discussed relative to FIGS. 4A-4C and may be covered by a fabric covering 44 as shown in FIGS. 5A-5B.

Figure 23B:
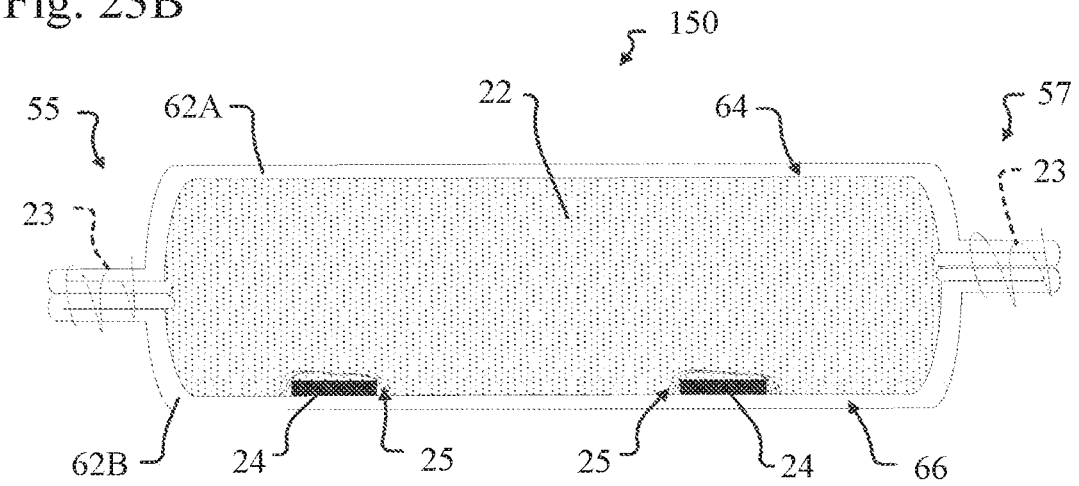
FIG. 23B is a cross-sectional view along the 23B-23B axis of the heel pad of FIG. 19A according to another embodiment of the present invention.

The cross-sections shown in FIGS. 23B and 24 are applicable to heel pad of this embodiment. In FIG. 23B, the flap 80A of the heel pad 150 includes two malleable members 24 that each separately extend along part of the length of the flap 80A. Separate member stitching 25 is used to fasten the two malleable members 24 proximate to the pliable body 62. It should be noted that while one flap 80A is shown, the malleable member 24 would be present in flap 80B as well. Additional methods of attaching the malleable members 24 can be used.

As illustrated in the cross-section of FIG. 24 the pad portion 77 of the pliable body 62 is constructed from two fabric layers 62A, 62B. Each fabric layer 62A/62B is folded on two opposing sides (first side 55 and second side 57). As shown, the upper fabric layer 62A is folded over itself at the first side 55 and folded over itself at the second side 57. Similarly, the lower fabric layer 62B is folded over itself at the first side 55 and folded over itself at the second side 57. The fabric layers 62A, 62B are stitched together at these folded sides using body stitching 23 (e.g., fabric stitching). In particular, the folded sides of the upper fabric layer 62A are stitched directly to the folded sides of the lower fabric layer 62B forming a seam along the body stitching 23. The upper fabric layer 62A is the foot side 64 of the pliable body 62 and the lower fabric layer 62B is the shoe side 66 of the pliable body 62. The two fabric layers may be of a single fabric sheet.

The heel pad portion 77 includes a filler element 22 contained within the pliable body 62 (i.e., between the upper fabric layer 62A and the lower fabric layer 62B). The filler element 22 typically includes a material that generally has soft, flexible, and moldable properties. For example, the filler element 22 can include a polyester pile, beads, foam, multiple sheets of polyester, microfiber, gel, feathers, silk, linen, rubber, synthetic plastic, rigid paper or other materials as appreciated by one of skill in the art.

FIGS. 22A, 22B, 22C, 25 and 26 illustrate use of the heel pad 150 in a shoe 34. In one example, a portion of the heel pad 150 folds along the upper edge 126B of the heel counter 126 and has a length to the end 70 of the flaps 80A, 80B between approximately 2.5 cm to 4.5 cm.

The shoe 34 includes an insole 28 coupled between a heel section 46 and a toebox (not shown). An ankle strap 115 is used to secure the shoe 34 to a foot of a user. The heel counter 126 has a nonstandard length L2. The heel section 46 includes a heel 36 attached below the heel counter 126. The heel pad 150 is positioned along an inner surface 126A of the heel counter 126. In addition to the shoe 34, the heel pad 150 may be used with casual shoes, dress shoes, sneakers, boots, sports shoes, ice skates, cross trainer shoes, cleats, ski boots, sandals, flats, or other shoes as appreciated by one of skill in the art.

The malleable member 24 within the flaps 80A, 80B of the heel pad 150 allows the flaps 80A, 80B to be bent or folded or shaped to conform over the rounded heel counter 126.

As illustrated in FIGS. 22A-22C, 25 and 26, the flaps 80A, 80B of the heel pad 150 are folded over the heel counter 126, such that the fold 65 of the foldable portion 63 sits on the edge 126B of the heel counter 126. In particular, the first end 68 of the heel pad 150 is positioned along the inner surface 126A of the heel counter 126 and the second end 70 (i.e., longitudinal end) of the heel pad 150 is folded along fold 65 and rests along an upper edge 126B of the heel counter 126 such that the flaps 80A, 80B mold to the outer surface of the heel counter 126. In some embodiments, the flaps 80A, 80B separate slightly, based on the constraints of the stitch 75, so that a gap 78 is present between the flaps 80A, 80B. It should be noted that the stitch 75 and the gap 78 present between the flaps 80A, 80B allow the flaps to be molded and secure to the outer surface 126C of the rounded heel counter 126.

Since the heel pad 150 includes a malleable member 24 that extends to the body stitching 23 of the pad portion 77, the heel pad 150 can accommodate various nonstandard heel counter lengths L2 by folding the heel pad 150 at various points along the pliable body 62. The length L2 is preferably measured from the insole 28 of the shoe 34 to the upper edge 126B of the heel counter 126. For example, FIGS. 22B, 22C, and 26 all have different nonstandard heel counter lengths L2, but can use heel pad 150 to provide protection to a wearer. Since the heel pad 150 is bent at different places along the pliable body, the amount of the flaps 80A, 80B of the heel pad 150 shown on the outer heel counter 126C will vary. It should be noted that the style of the shoe the heel pad 150 is inserted into may vary, for example the type of strap 115 used to secure the shoe to the user. It should also be noted that in some of the drawings, the heel counter length is shown on the back of the shoe for illustrative purposes, but is measured from the insole of the shoe to the upper edge of the heel counter and not on the back of the shoe.

Figure 25:
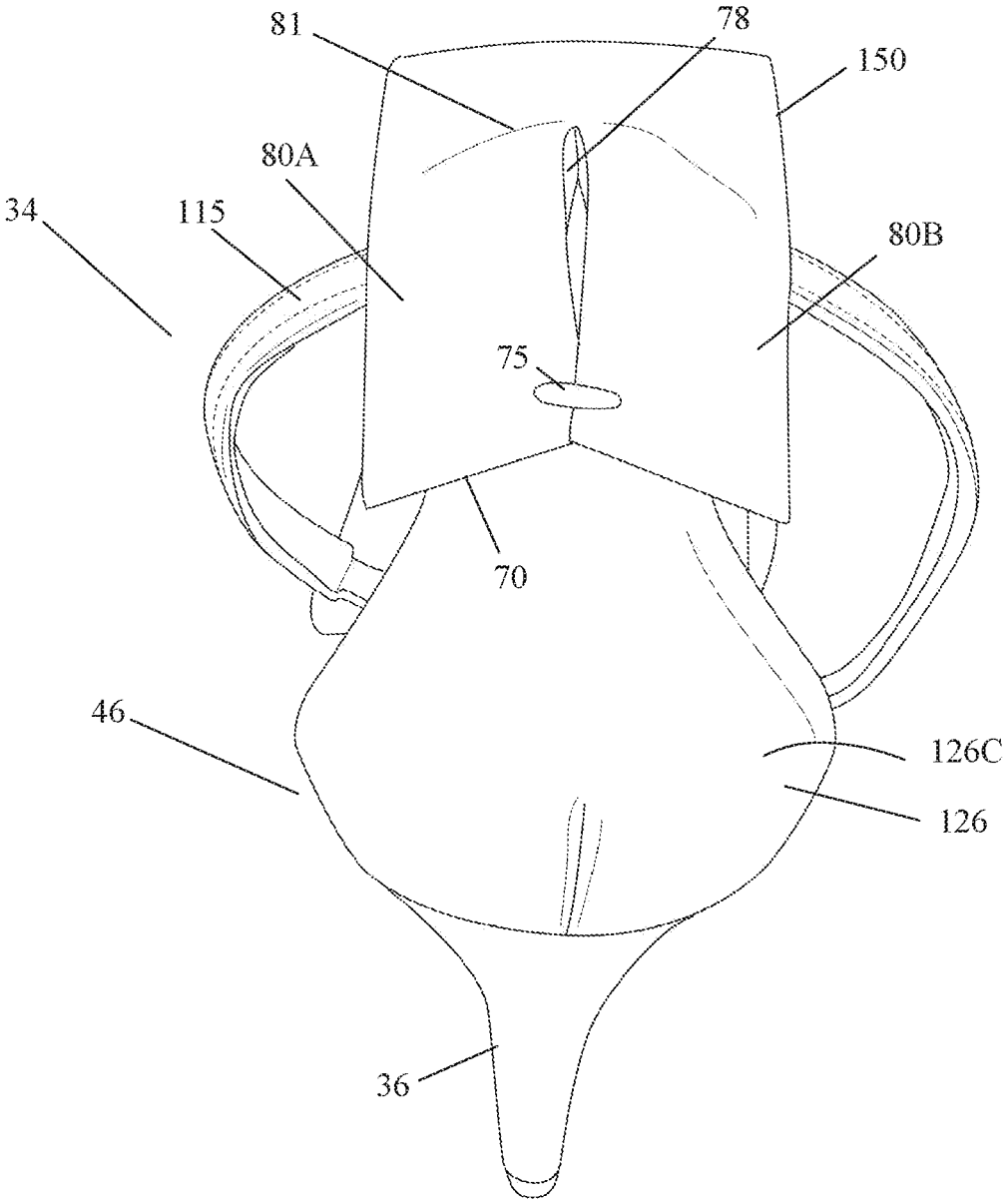
FIG. 25 is a back view showing the heel pad of another alternate embodiment in a shoe with a heel counter of a nonstandard length.
Figure 26:
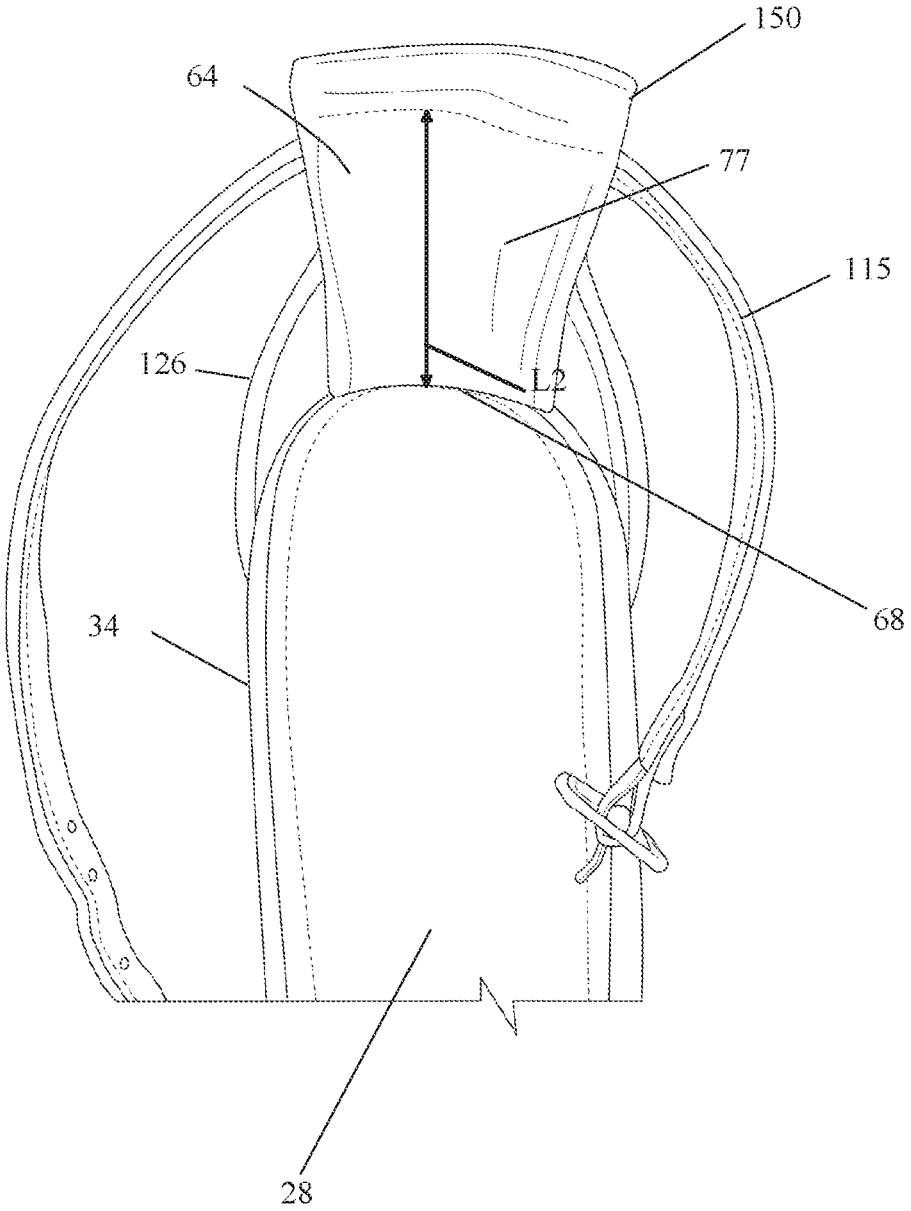
FIG. 26 is a front view showing the heel pad of another alternate embodiment in a shoe with a heel counter of a nonstandard length.

FIGS. 25 and 26 show front and back views of a shoe with a nonstandard length L2 heel counter. FIG. 25 shows a back view of the heel pad 150 inserted into and folded over the upper edge 126B of heel counter 126 having a length L2 and FIG. 26 shows a front view of the heel pad 150 inserted into and folded over the upper edge 126B of the heel counter 126 having a length L2.

The heel pad 150 can be supplemented with an extender heel pad 30. The additional extender heel pad 30 expands the coverage area and length of the heel pad 150. This results in an extension of the length of coverage for padding the wearer's heel which is particularly useful with nonstandard length shoes, for example shoe 34.

Figure 22A:
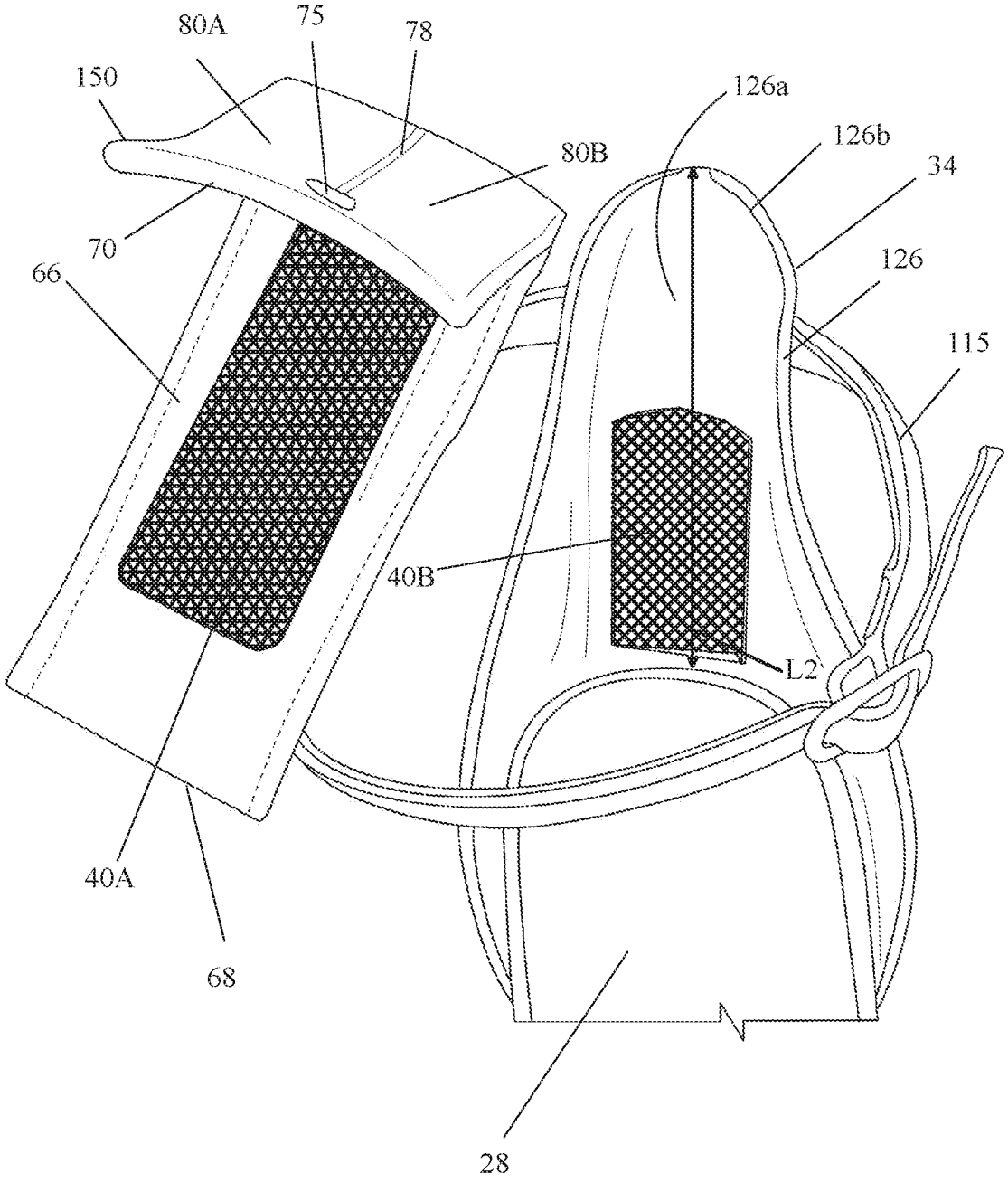
FIG. 22A is a partial perspective view of the heel pad of another alternate embodiment having a fastener for attaching the heel pad within an alternate shoe having a nonstandard heel counter length according to an embodiment of the present invention.
Figure 22B:
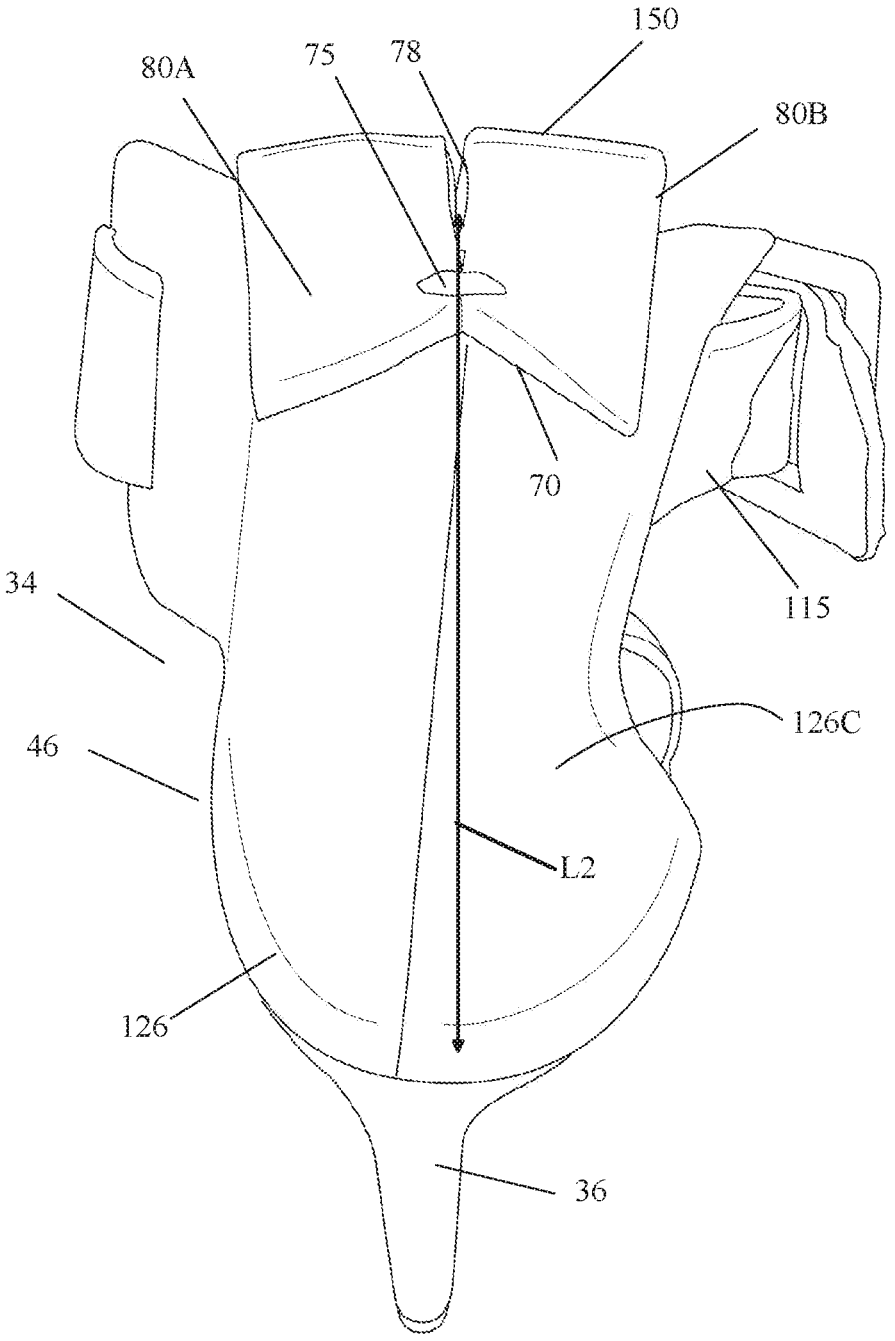
FIG. 22B is a back perspective view of the heel pad of another alternate embodiment positioned in an alternate shoe having a nonstandard heel counter length.
Figure 22C:
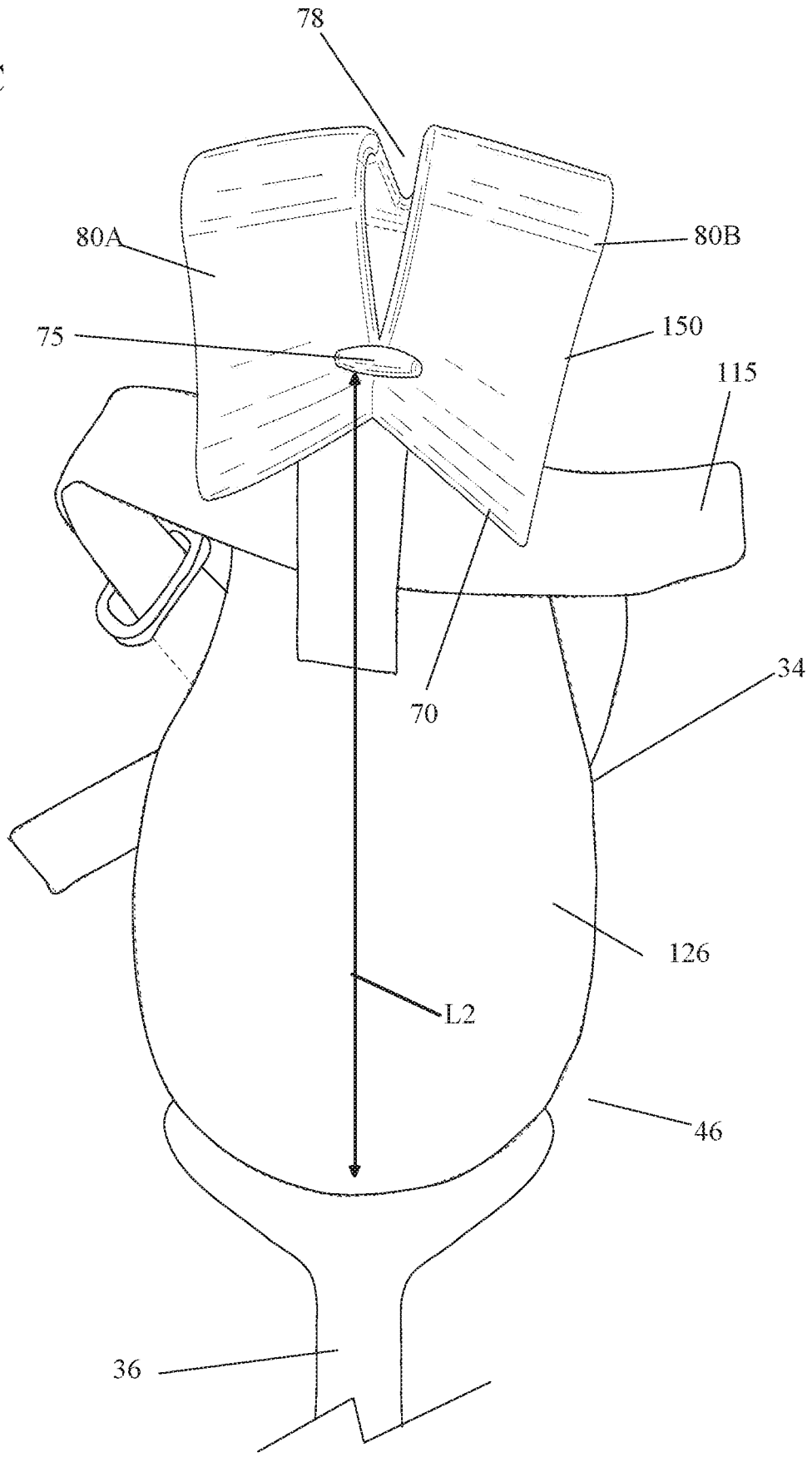
FIG. 22C is a back perspective view of the heel pad of another alternate embodiment positioned in an alternate shoe having a nonstandard heel counter length.

As illustrated in FIG. 22A the heel pad 150 can include a fastener for attaching the heel pad 150 within a shoe 34. The fastener provides additional support in maintaining the heel pad 150 within the shoe (i.e., assist in keeping the heel pad 150 in place). For example, the shoe side 66 of the heel pad 150 is releasably attached to the inner surface 126A of the heel counter 126 of the shoe 34 using the fastener such that the heel pad 150 is attached and detached from the heel counter 126 of the shoe 34.

The heel pad 150 can utilize a hook and loop type of fastener for attaching the heel pad 150 within the shoe 34. In particular, the shoe side 66 of the heel pad 150 includes a hook fastener section 40A which releasably attaches to or detaches from a loop fastener section 40B on the inner surface 126A of the heel counter 126 of the shoe 34.

The heel pad 150 can be adhered into the shoe 34 using a different fastener such as an adhesive strip (e.g., peel and stick type of adhesive). In one example, the adhesive strip is placed on the shoe side 66 of the heel pad 150 and the heel pad 150 is attached to the heel counter 126 using the adhesive strip. In another example, one adhesive strip is placed on the 30 shoe side 66 of the heel pad 150 and a complementary adhesive strip is placed on the inner surface 126A of the heel counter 126. The heel pad 150 is attached to the heel counter 126 using these complementary adhesive strips.

The heel pad 150 can use other fastening means such as sewing, tacking, riveting, button fasteners, magnetic fasteners, or other adhesive mechanisms for providing additional support in attaching the heel pad 150 into the heel counter 126 as appreciated by one of skill in the art.

While this invention has been particularly shown and described with references to preferred embodiments thereof, it will be understood by those skilled in the art that various changes in form and details may be made therein without departing from the scope of the invention encompassed by the appended claims.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

The invention claimed is:

1. A heel pad configured for placement over a heel section of a shoe, the heel pad comprising:

a pliable body having a first end and a second end and having a foldable portion positioned between the first end and second end of the pliable body;

wherein the pliable body further contains a first foldable flap extending from a location between the foldable portion and the second end of the pliable body to the second end of the pliable body, and a second foldable flap extending from a location between the foldable portion and the second end of the pliable body to the second end of the pliable body;

a pad portion of the pliable body located between the first end of the pliable body and the foldable portion of the pliable body;

wherein the first foldable flap and second foldable flap are fastened together at the second end of the pliable body; and further wherein the fastening of the first foldable flap and second foldable flap at the second end of the pliable body is configured to form a gap between the first foldable flap and the second foldable flap when the first foldable flap and second foldable flap are folded, wherein the gap extends from a location between the foldable portion and the second end of the pliable body to the second end of the pliable body.

2. The heel pad of claim 1, wherein the pliable body is constructed from fabric or leather.

3. The heel pad of claim 1, wherein the heel pad is attached to the shoe by magnetic fasteners.

4. The heel pad of claim 1, wherein the heel pad further contains fastening means selected from the group consisting of tacking, riveting, button fasteners, adhesive, hook and loop fastener, and sewing configured to attach the heel pad to the heel section of the shoe.

5. The heel pad of claim 1, wherein the heel pad is integrally formed within the heel section of the shoe.

6. The heel pad of claim 1, wherein the pad portion contains a filler element.

7. A heel pad configured for placement over a heel section of a shoe, the heel pad comprising:

a pliable body having a first end and a second end and having a foldable portion positioned between the first end and second end of the pliable body;

wherein the pliable body further contains a first foldable flap extending from a location between the foldable portion and the second end of the pliable body to the second end of the pliable body, and a second foldable flap extending from a location between the foldable portion and the second end of the pliable body to the second end of the pliable body;

wherein the first foldable flap and second foldable flap are fastened together at the second end of the pliable body; and further wherein the fastening of the first foldable flap and second foldable flap at the second end of the pliable body is configured to form a gap between the first foldable flap and the second foldable flap when the first foldable flap and second foldable flap are folded, wherein the gap extends from a location between the foldable portion and the second end of the pliable body to the second end of the pliable body.

8. The heel pad of claim 7, wherein the pliable body is constructed from fabric or leather.

9. The heel pad of claim 7, wherein the heel pad is attached to the shoe by magnetic fasteners.

10. The heel pad of claim 7, wherein the heel pad further contains fastening means selected from the group consisting of tacking, riveting, button fasteners, adhesive, hook and loop fastener, and sewing configured to attach the heel pad to the heel section of the shoe.

11. A shoe comprising the heel pad of claim 7, wherein the heel pad is integrally formed within the heel section of the shoe.

* * * * *